US012660889B2

(12) United States Patent
Chua et al.

(10) Patent No.: US 12,660,889 B2
(45) Date of Patent: Jun. 23, 2026

(54) SOLE STRUCTURE FOR ARTICLE OF FOOTWEAR

(71) Applicant: NIKE, Inc., Beaverton, OR (US)

(72) Inventors: Matthew Chua, Beaverton, OR (US); Madeline P. Hoffert, Portland, OR (US); Oliver McLachlan, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/311,793

(22) Filed: Aug. 27, 2025

(65) Prior Publication Data

US 2025/0386904 A1 Dec. 25, 2025

Related U.S. Application Data

(63) Continuation of application No. 18/606,833, filed on Mar. 15, 2024, now Pat. No. 12,414,610, which is a (Continued)

(51) Int. Cl.
*A43C 15/16* (2006.01)
*A43B 13/22* (2006.01)

(52) U.S. Cl.
CPC ..... *A43C 15/161* (2013.01); *A43B 13/223* (2013.01); *A43C 15/162* (2013.01)

(58) Field of Classification Search
CPC ..... A43C 15/161–168; A43B 13/223
See application file for complete search history.

(56) References Cited

U.S. PATENT DOCUMENTS 1,594,056 A 7/1926 Floyd
1,876,195 A 9/1932 Youmans
(Continued)

FOREIGN PATENT DOCUMENTS

DE 3127793 C1 1/1983
GB 1078144 A 8/1967
(Continued)

OTHER PUBLICATIONS

European Patent Office, International Search Report and Written Opinion for application No. PCT/US2021/049850 dated Jan. 5, 2022.
(Continued)

*Primary Examiner* — Ted Kavanaugh
(74) *Attorney, Agent, or Firm* — Honigman LLP; Matthew H. Szalach

(57) ABSTRACT

A sole structure for an article of footwear includes a first annular group of traction elements arranged along a first annular zone and a second annular group of traction elements arranged along a second annular zone concentric with the first annular group. The first and second annular groups of traction elements include a plurality of directional traction elements arranged in a first rotational direction about a common rotation zone. Optionally, the first annular group of traction elements may include an omnidirectional traction element arranged at a location associated with a relatively low degree of alignment between radii of rotation corresponding to different torsional movements of the sole structure during use. The directional traction elements may include unidirectional traction elements or bidirectional traction elements at locations associated with moderate to high degrees of alignment between radii of rotation corresponding to the different torsional movements.

20 Claims, 16 Drawing Sheets

Related U.S. Application Data continuation of application No. 17/470,790, filed on Sep. 9, 2021, now Pat. No. 11,957,216.

(60) Provisional application No. 63/077,208, filed on Sep. 11, 2020.

(56) References Cited

U.S. PATENT DOCUMENTS

| | | | |
|---|---|---|---|
| 4,347,674 | A | 9/1982 | George |
| 4,564,966 | A | 1/1986 | Chen |
| 4,670,997 | A | 6/1987 | Beekman |
| 4,689,901 | A | 9/1987 | Ihlenburg |
| D292,443 | S | 10/1987 | Ihlenburg |
| D294,655 | S | 3/1988 | Heyes |
| D295,231 | S | 4/1988 | Heyes |
| D303,730 | S | 10/1989 | Autry et al. |
| 5,201,126 | A | 4/1993 | Tanel |
| 5,782,017 | A | 7/1998 | Ortscheid |
| D399,342 | S | 10/1998 | Carlson |
| D406,938 | S | 3/1999 | Lin |
| 6,016,613 | A | 1/2000 | Campbell et al. |
| 6,101,746 | A | 8/2000 | Evans |
| D460,247 | S | 7/2002 | Liu et al. |
| D617,542 | S | 6/2010 | Stauffer |
| D675,416 | S | 2/2013 | Minami |
| 10,881,168 | B2 | 1/2021 | Markison et al. |
| 11,751,639 | B2 | 9/2023 | Ekstrom et al. |
| D1,000,791 | S | 10/2023 | Lesecq |
| 11,957,216 | B2 | 4/2024 | Chua et al. |
| 12,414,610 | B2 * | 9/2025 | Chua ..... A43B 13/26 |
| 2002/0004999 | A1 | 1/2002 | Caine et al. |
| 2003/0192199 | A1 | 10/2003 | Nakano et al. |
| 2008/0010860 | A1 | 1/2008 | Gyr |
| 2009/0100716 | A1 | 4/2009 | Gerber |
| 2013/0067771 | A1 | 3/2013 | Minami |
| 2013/0067777 | A1 | 3/2013 | Minami |
| 2013/0067778 | A1 | 3/2013 | Minami |
| 2014/0082968 | A1 | 3/2014 | Binzer |
| 2017/0238654 | A1 | 8/2017 | Baghdadi et al. |
| 2017/0354198 | A1 | 12/2017 | Gilkey |
| 2018/0000191 | A1 | 1/2018 | Bacon et al. |
| 2021/0259367 | A1 | 8/2021 | Ekstrom et al. |

FOREIGN PATENT DOCUMENTS

| | | | |
|---|---|---|---|
| IT | MI20101453 | A1 | 1/2012 |
| WO | WO-2021173619 | A1 | 9/2021 |

OTHER PUBLICATIONS

European Patent Office, Communication pursuant to Article 94(3) EPC for EP App. No. 21790331.9, mailed Jan. 3, 2024.

USPTO, Non-Final Office Action for U.S. Appl. No. 17/470,790, mailed on Aug. 31, 2023.

European Patent Office, Communication pursuant to Article 94(3) EPC for EP App. No. 21790331.9, mailed May 8, 2024.

European Patent Office, Communication pursuant to Article 94(3) EPC for EP App. No. 21790331.9, mailed Dec. 13, 2024.

* cited by examiner

FIG. 1E
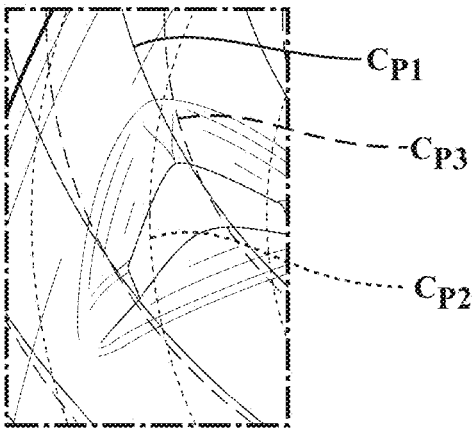
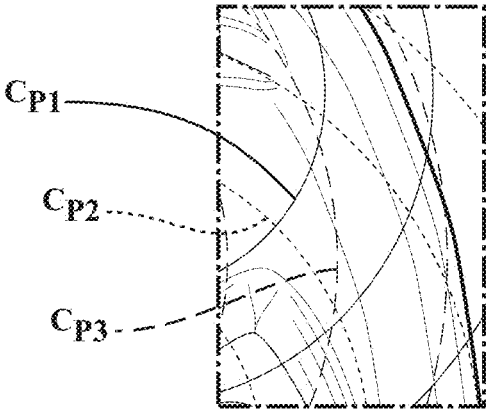
FIG. 1F
FIG. 1G
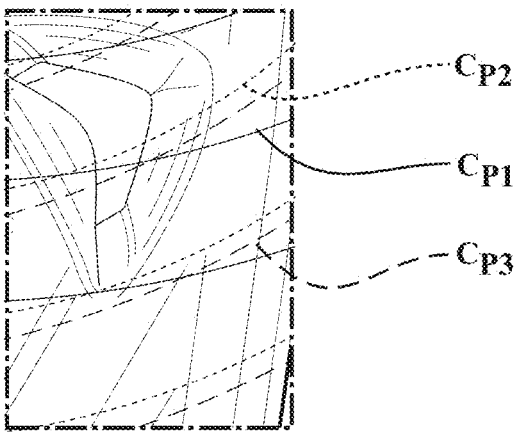

SOLE STRUCTURE FOR ARTICLE OF FOOTWEAR

CROSS REFERENCE TO RELATED APPLICATIONS

This application is a continuation of U.S. application Ser. No. 18/606,833, filed on Mar. 15, 2024, which is a continuation of U.S. application Ser. No. 17/470,790, filed on Sep. 9, 2021, which claims priority under 35 U.S.C. § 119 (e) to U.S. Provisional Application No. 63/077,208, filed on Sep. 11, 2020. The disclosures of these prior applications are considered part of the disclosure of this application and are hereby incorporated by reference in their entirety.

FIELD

The present disclosure relates generally to an article of footwear, and more particularly to a sole structure for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. For example, a sole structure may include a midsole and an outsole. The midsole is generally disposed between the outsole and the upper and provides cushioning for the foot. The midsole may include a pressurized fluid-filled chamber that compresses resiliently under an applied load to cushion the foot by attenuating ground-reaction forces. The outsole provides abrasion-resistance and traction with the ground surface and may be formed from rubber or other materials that impart durability and wear-resistance, as well as enhancing traction with the ground surface.

While known outsoles have proven acceptable for their intended purposes, a continuous need for improvement in the relevant art remains. For example, a need exists for an outsole that provides improved traction with the ground surface when forces having varying magnitude and direction are applied from the midsole or the upper to the outsole. A need also exists for an article of footwear having improved overall comfort and fit while providing such improved traction.

DRAWINGS

The drawings described herein are for illustrative purposes only of selected configurations and not all possible implementations, and are not intended to limit the scope of the present disclosure.

FIGS. 1E-1G are enlarged environmental views showing radii associated with the first, second, and third centroids and respectively taken at Areas 1E-1G of FIG. 1D;

Corresponding reference numerals indicate corresponding parts throughout the drawings.

DETAILED DESCRIPTION

Figure 1A:
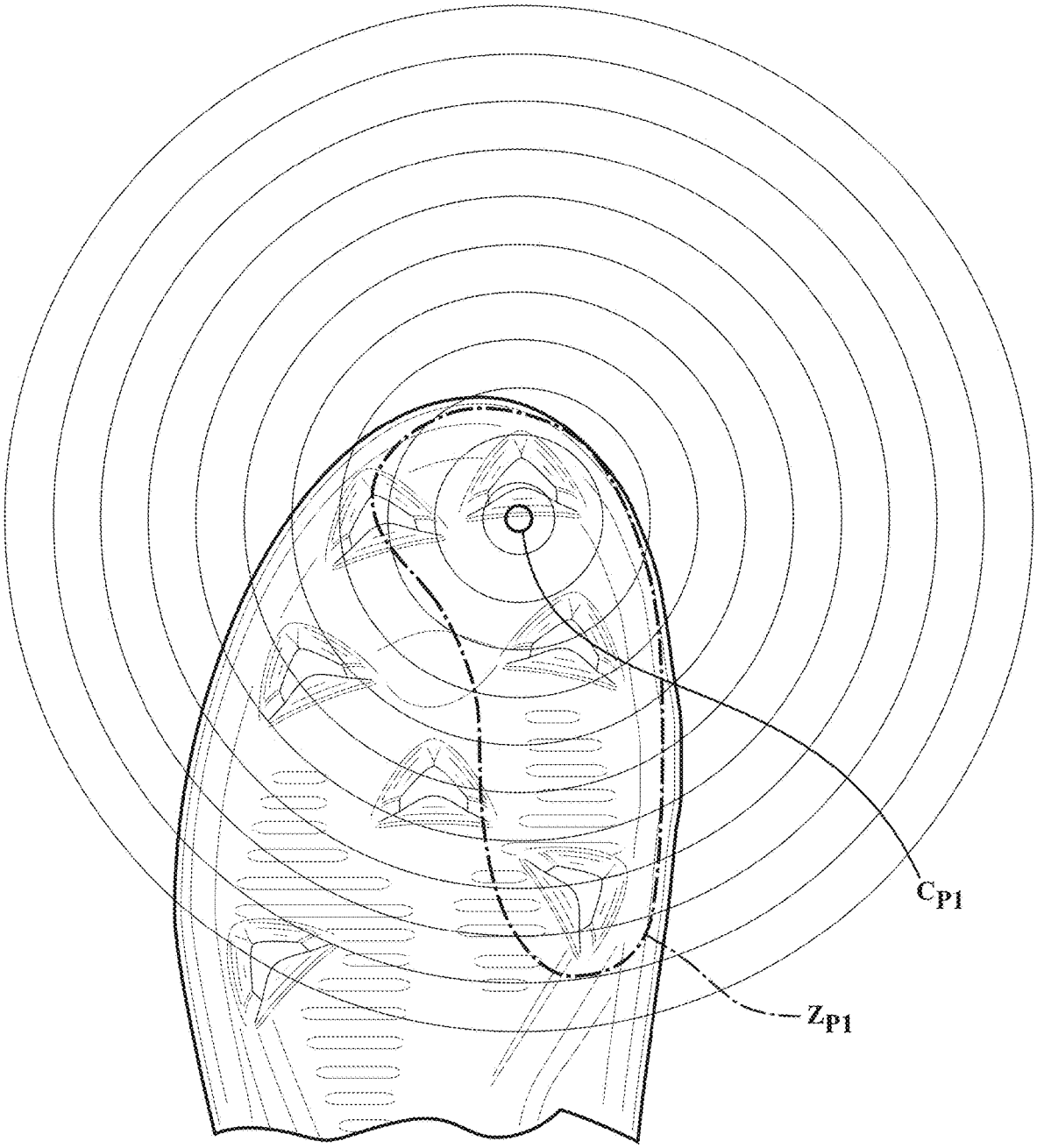
FIG. 1A is an environmental view illustrating a contact zone and centroid associated with an article of footwear and resulting from a first movement.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The details of one or more implementations of the disclosure are set forth in the accompanying drawings and the description below. Other aspects, features, and advantages will be apparent from the description, the drawings, and the claims.

In one aspect of the disclosure, a structure for an article of footwear includes a first plurality of traction elements having a first series of directional traction elements arranged within a first annular zone in a first rotational direction around a pivot zone. The sole structure further includes a second plurality of traction elements including a second series of directional traction elements arranged within a second annular zone concentric with and larger than the first annular zone. The second plurality of traction elements are arranged in the first rotational direction around the pivot zone.

Aspects of the disclosure may include one or more of the following optional features. In some examples, each of the directional traction elements is elongate and includes a length extending from a first end to a second end along the first rotational direction. In some implementations, each of the directional traction elements includes a chamfer formed adjacent to at least one of the first end and the second end.

In some configurations, each of the directional traction elements includes a concave inner surface and a convex outer surface each extending along the first rotational direction. Optionally, the inner surface converges with the outer surface along the first rotational direction.

In some implementations, the sole structure includes a third plurality of directional traction elements disposed in a heel region, each of the directional traction elements of the third plurality of directional traction elements oriented in the first rotational direction. In some examples, the first plurality of traction elements and the second plurality of traction elements are disposed in a forefoot region of the sole structure.

In some configurations, the first plurality of traction elements further includes an omnidirectional traction element arranged within the first annular zone. Here, the omnidirectional traction element is disposed on a medial side of the sole structure and at least one of the directional traction elements of the first series is disposed on a lateral side of the sole structure. In some examples, at least one of directional traction elements includes a unidirectional traction element and at least one of the directional traction elements includes a bidirectional traction element.

Another aspect of the disclosure provides a sole structure for an article of footwear including a first annular group of traction elements and a second annular group of traction elements. The first annular group of traction elements is arranged in series along a first annular zone in a forefoot region. The first annular group includes a first directional traction element on a lateral side of the sole structure and a second directional traction element on a medial side of the sole structure. The second annular group of traction elements is arranged in series along a second annular zone concentric with the first annular zone. The second annular group of traction elements includes a third directional traction element on the lateral side of the sole structure and a fourth directional traction element on the medial side of the sole structure.

Aspects of the disclosure may include one or more of the following optional features. In some examples, each of the directional traction elements is elongate and includes a length extending from a first end to a second end along a first rotational direction around a pivot zone of the sole structure. Optionally, each of the directional traction elements includes a chamfer formed adjacent to at least one of the first end and the second end.

In some implementations, each of the directional traction elements includes a concave inner surface and a convex outer surface each extending along the first rotational direction. In some examples, the inner surface converges with the outer surface along the first rotational direction. Optionally, the sole structure includes a third group of directional traction elements disposed in a heel region, each of the directional traction elements of the third group of directional traction elements oriented in the first rotational direction. In some configurations, the first annular group and the second annular group are disposed in the forefoot region of the sole structure.

In some examples, the first annular group of traction elements further includes an omnidirectional traction element arranged along the first annular zone. Here, the omnidirectional traction element may be disposed on a medial side of the sole structure. In some implementations, at least one of directional traction elements includes a unidirectional traction element and at least one of the directional traction elements includes a bidirectional traction element.

Figure 1B:
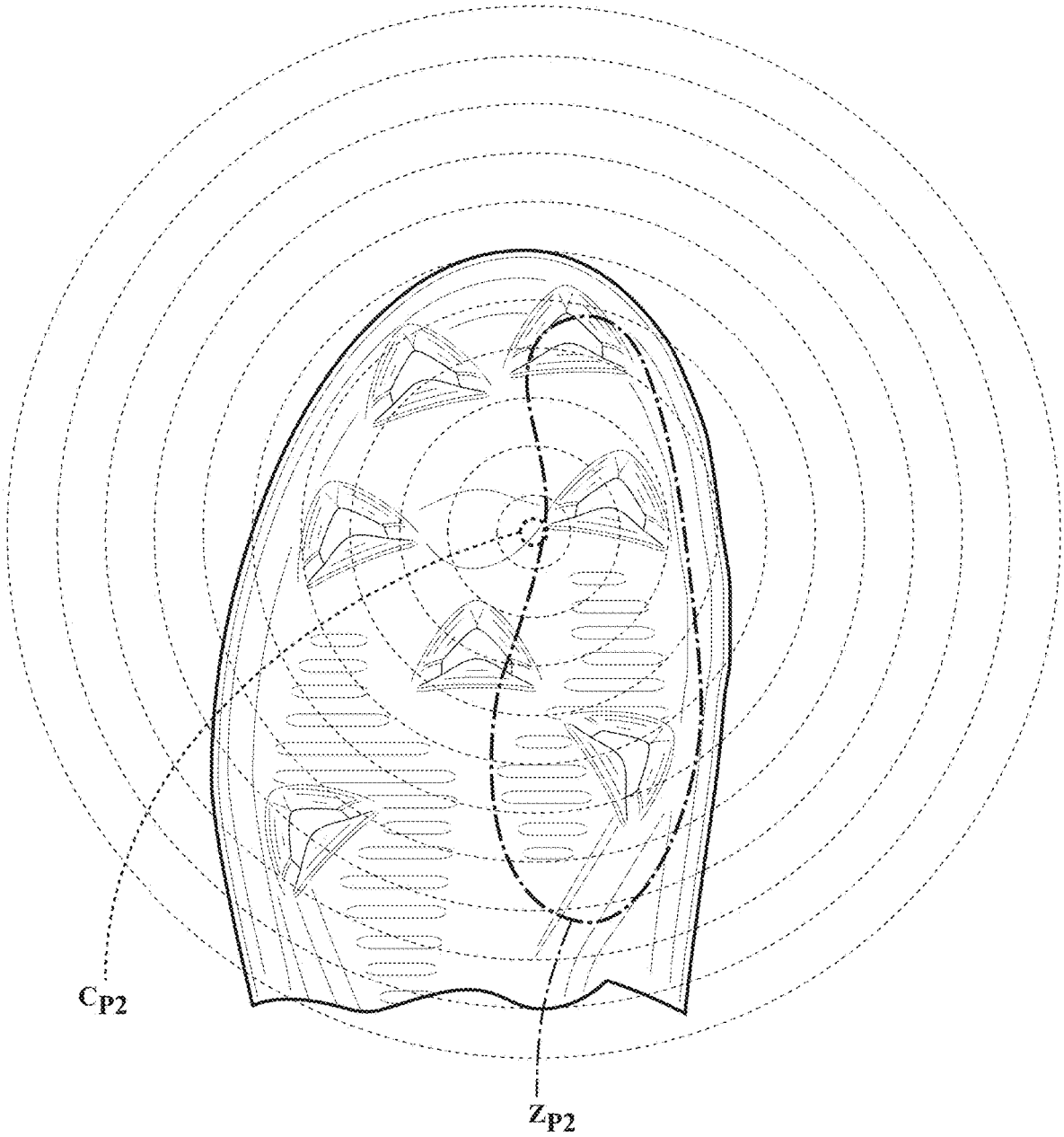
FIG. 1B is an environmental view illustrating a contact zone and centroid associated with an article of footwear and resulting from a second movement.
Figure 1C:
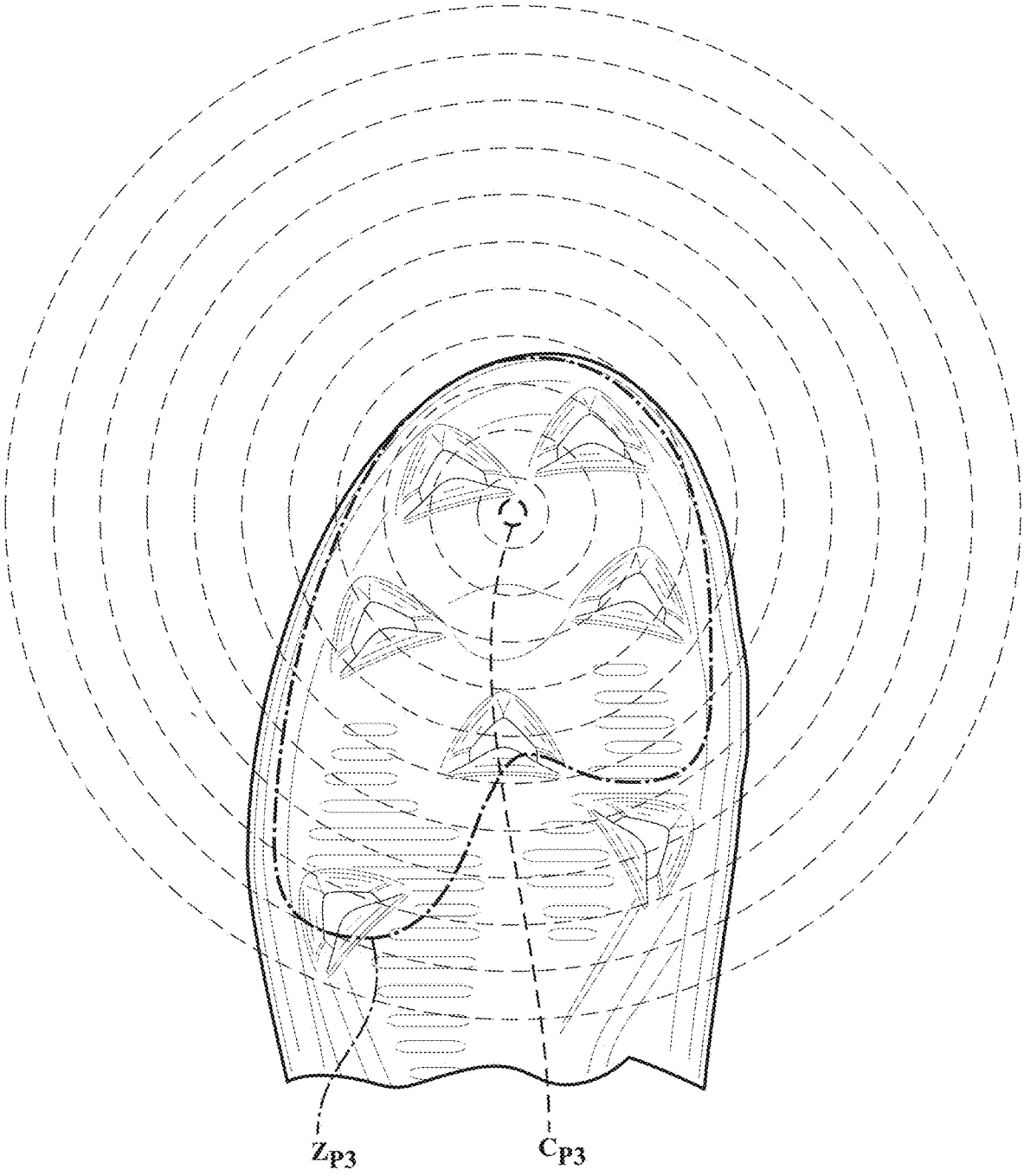
FIG. 1C is an environmental view illustrating a contact zone and centroid associated with an article of footwear and resulting from a third movement.

FIGS. 1A-IF illustrate examples of reactionary forces and motions corresponding to common athletic movements associated with an article of footwear. As shown, these forces and motions are illustrated with respect to an article of footwear including a conventional pattern of traction elements configured for translational (i.e., lateral, longitudinal) traction with a ground surface. In FIG. 1A, a first contact zone $Z_{P1}$ associated with a 45° outside cut (i.e., forward and lateral direction) is shown. Here, the first contact zone $Z_{P1}$ indicates a pressure area along the anterior-medial side of the article of footwear, with a higher degree of contact at the anterior end associated with the 45° movement. A centroid $C_{P1}$ associated with the first contact zone $Z_{P1}$ is located adjacent to an anterior end of the article of footwear. FIG. 1B illustrates a second contact zone $Z_{P2}$ and second centroid $C_{P2}$ corresponding to a second movement associated with a 180° outside cut (i.e., lateral direction). As shown, the second contact zone $Z_{P2}$ and second centroid $C_{P2}$ are shifted away from the anterior end and towards the lateral side relative to the first contact zone $Z_{P1}$ and first centroid $C_{P1}$. FIG. 1C illustrates a third contact zone $Z_{P3}$ and third centroid $C_{P3}$ corresponding to a third movement associated with a 90° inside cut (i.e., longitudinal direction), such as an acceleration, deceleration, or planting kick. Here, the third contact zone $Z_{P3}$ includes a full width of the sole structure such that the third centroid $C_{P3}$ is closer to the lateral side than the first and second centroids $C_{P1}$, $C_{P2}$. For clarity, FIGS. 1A-1C each show a plurality of radii of rotation associated with the respective centroids $C_{P1}$, $C_{P2}$, $C_{P3}$, which will be discussed in greater detail with respect to FIGS. 1D-1G. As discussed throughout the application, the centroids $C_{P1}$, $C_{P2}$, $C_{P3}$ may collectively define a rotational or pivot zone $Z_P$ which is an area of the sole structure encompassing all three of the centroids $C_{P1}$, $C_{P2}$, $C_{P3}$ about which the sole structure may pivot during any one of the three movements.

Figure 1D:
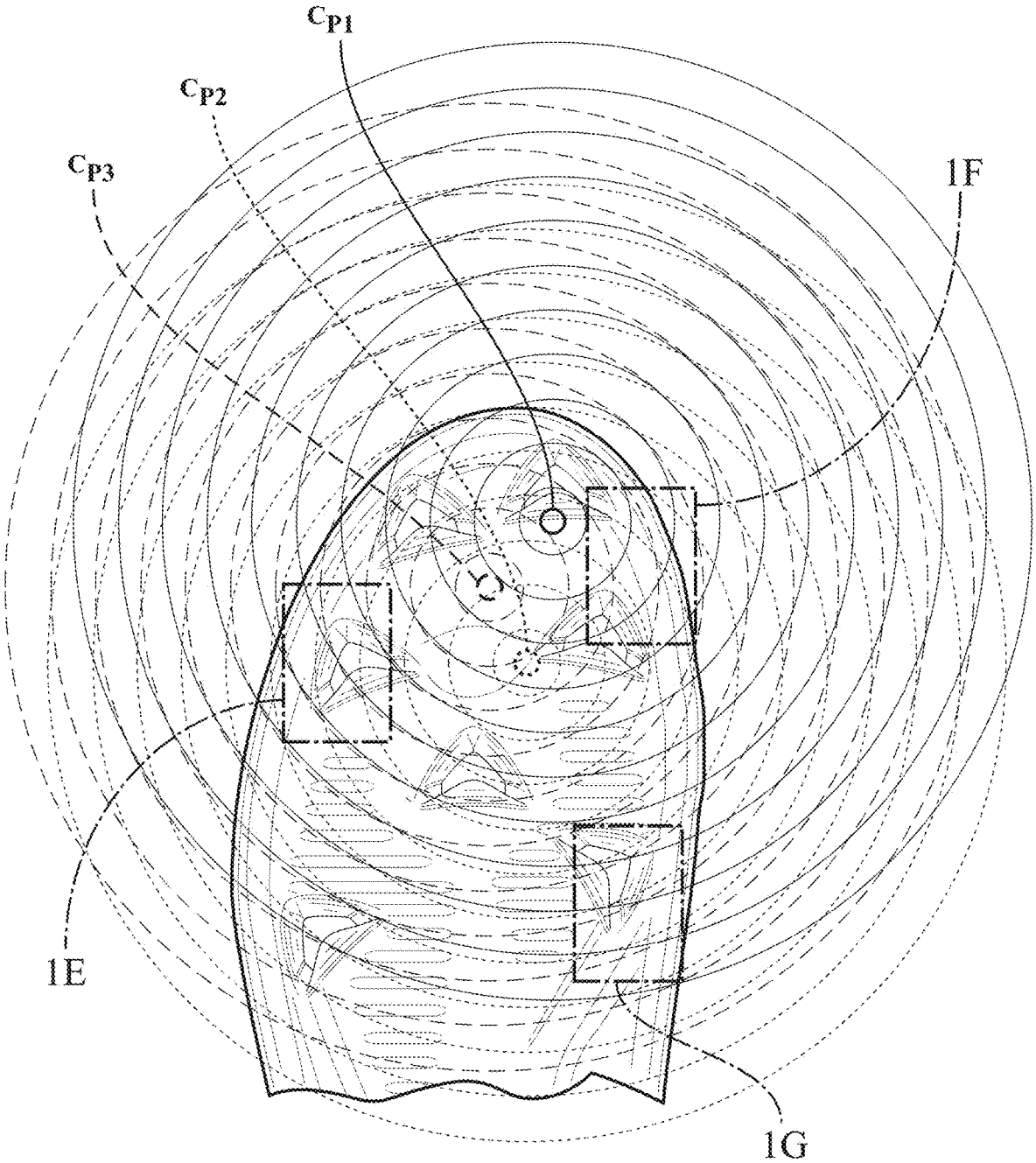
FIG. 1D is an environmental view showing the centroids associated with the first, second, and third movements overlaid onto an article of footwear.

FIGS. 1D-1G illustrate the relationships between the rotational motions corresponding to each of the first, second, and third centroids $C_{P1}$, $C_{P2}$, $C_{P3}$ associated with the first, second, and third movements. In FIG. 1D, the rotational radii corresponding to each of the centroids $C_{P1}$, $C_{P2}$, $C_{P3}$ are all overlaid upon the same example sole structure. As shown, the rotational radii are offset relative to one another such that the rotational radii have different degrees of alignment at different areas of the sole structure. For example, at Area 1E (FIG. 1E), the rotational radii associated with the first centroid $C_{P1}$ (solid line) and the third centroid $C_{P3}$ (dashed line) have a relatively high degree of alignment (e.g., tangentially) to each other while the rotational radius associated with the second centroid $C_{P2}$ (solid line) extends transversely to the rotational radii associated with the second centroid $C_{P2}$ and the third centroid $C_{P3}$. Accordingly, at Area 1E, the sole structure moves in a similar rotational direction during a 45° outside cut and a 90° inside cut, but moves along a different rotational path during a 180° outside cut. In another example, at Area IF (FIG. 1F), the rotational radii associated with the first, second, and third centroids $C_{P1}$, $C_{P2}$, $C_{P3}$ have a relatively low degree of alignment with each other. Thus, the sole structure moves in different rotational directions at Area IF during a 45° outside cut, a 180° outside cut, and a 90° inside cut. At Area 1G (FIG. 1G) the rotational radii associated with the first, second, and third centroids $C_{P1}$, $C_{P2}$, $C_{P3}$ have a relatively high degree of alignment with each other, indicating that the sole structure moves along a common rotational path at Area 1G during a 45° outside cut, a 180° outside cut, and a 90° inside cut.

With continued reference to FIGS. 1D-1G, the different degrees of alignment between the rotational radii of the first, second, and third centroids $C_{P1}$, $C_{P2}$, $C_{P3}$ may affect a torsional force associated with the article of footwear based on the shape, location, and orientation of traction elements on the article of footwear. For instance, the example of the article of footwear shown in FIGS. 1D-1G includes chevron-shaped traction elements arranged in a random pattern with broad faces of the traction elements being transverse to the rotational radii. Thus, in areas of the sole structure having a relatively high degree of alignment (e.g., Areas 1E, 1G), conventional configurations and shapes of traction elements may impart a higher torsional force during the associated movements (e.g., cuts, kicks, etc.) as the traction elements engage the ground surface along the direction of the rotational radii.

As discussed in greater detail below, the examples of the articles of footwear 10, 10*a*, 10*b* according to the present disclosure are configured to tune torsional forces associated with the articles of footwear 10, 10*a*, 10*b* by providing an annular series of traction elements that are aligned with one another based on an optimized alignment with the rotational radii. Here, combinations of directional traction elements and omnidirectional traction elements are incorporated based on the relationship between the rotational radii. For instance, directional traction elements are provided in areas of the sole structure associated with relatively high degrees of alignment between rotational radii, while omnidirectional traction elements are provided in areas of the sole structure associated with relatively low degrees of alignment between rotational radii.

Figure 2:
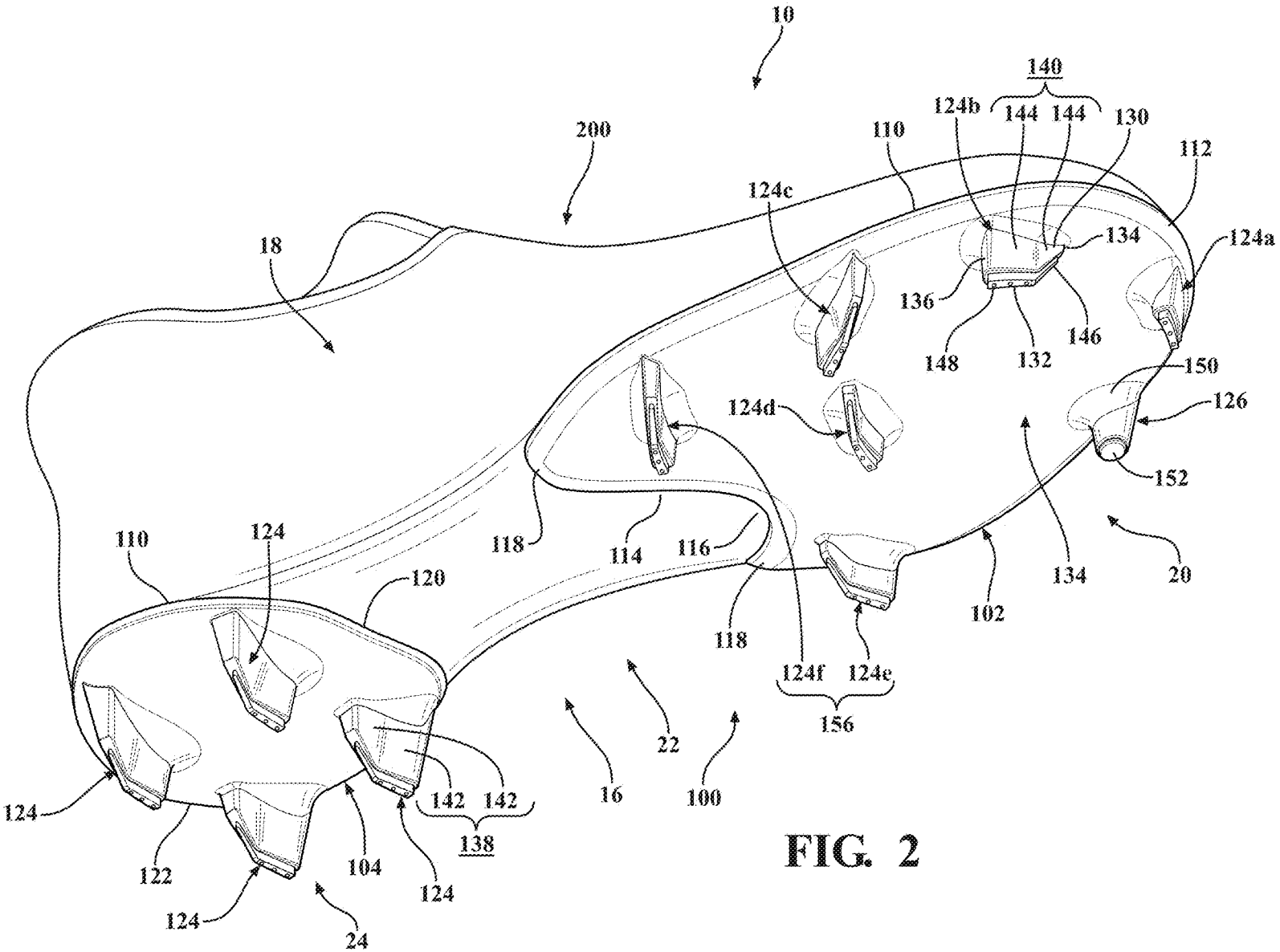
FIG. 2 is a bottom perspective view of an example of an article of footwear according to the present disclosure.
Figure 3:
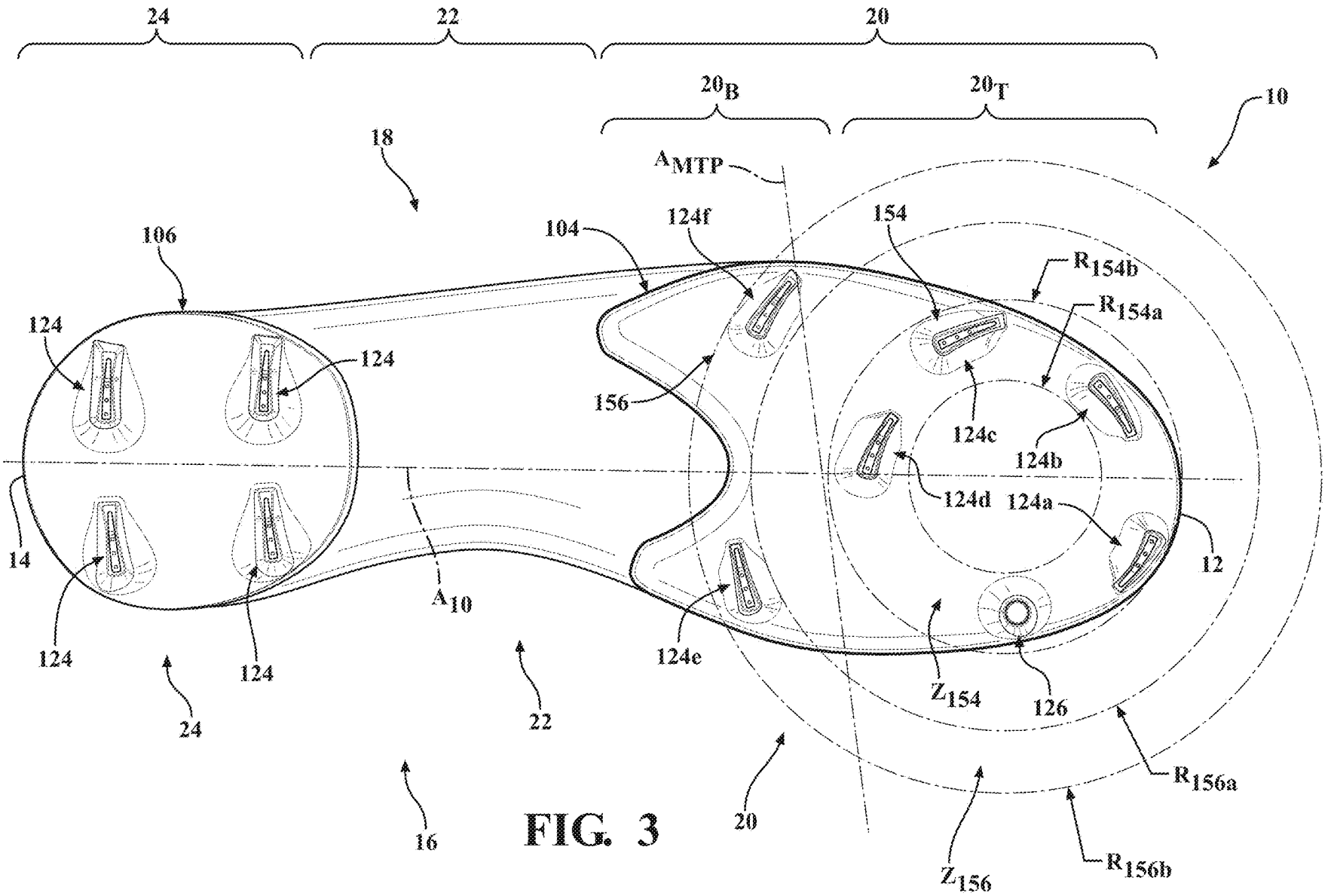
FIG. 3 is a bottom plan view of the article of footwear of FIG. 2.

Referring to FIG. 2, an article of footwear 10 includes a sole structure 100 and an upper 200 attached to the sole structure 100. The footwear 10 may further include an anterior end 12 associated with a forward-most point of the footwear, and a posterior end 14 corresponding to a rearward-most point of the footwear 10. As shown in FIG. 3, a longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 may be subdivided into a toe portion 20*r* corresponding with phalanges and a ball portion 20B associated with metatarsal bones of a foot. As shown, the article of footwear 10 may be described in terms of a metatarsophalangeal (MTP) axis $A_{MTP}$ corresponding to an MTP joint of the foot, which generally extends between the toe portion 20*r* and the ball portion 20B. The mid-foot region 22 may correspond with an arch area of the foot, and the heel region 24 may correspond with rear portions of the foot, including a calcaneus bone.

Figure 4:
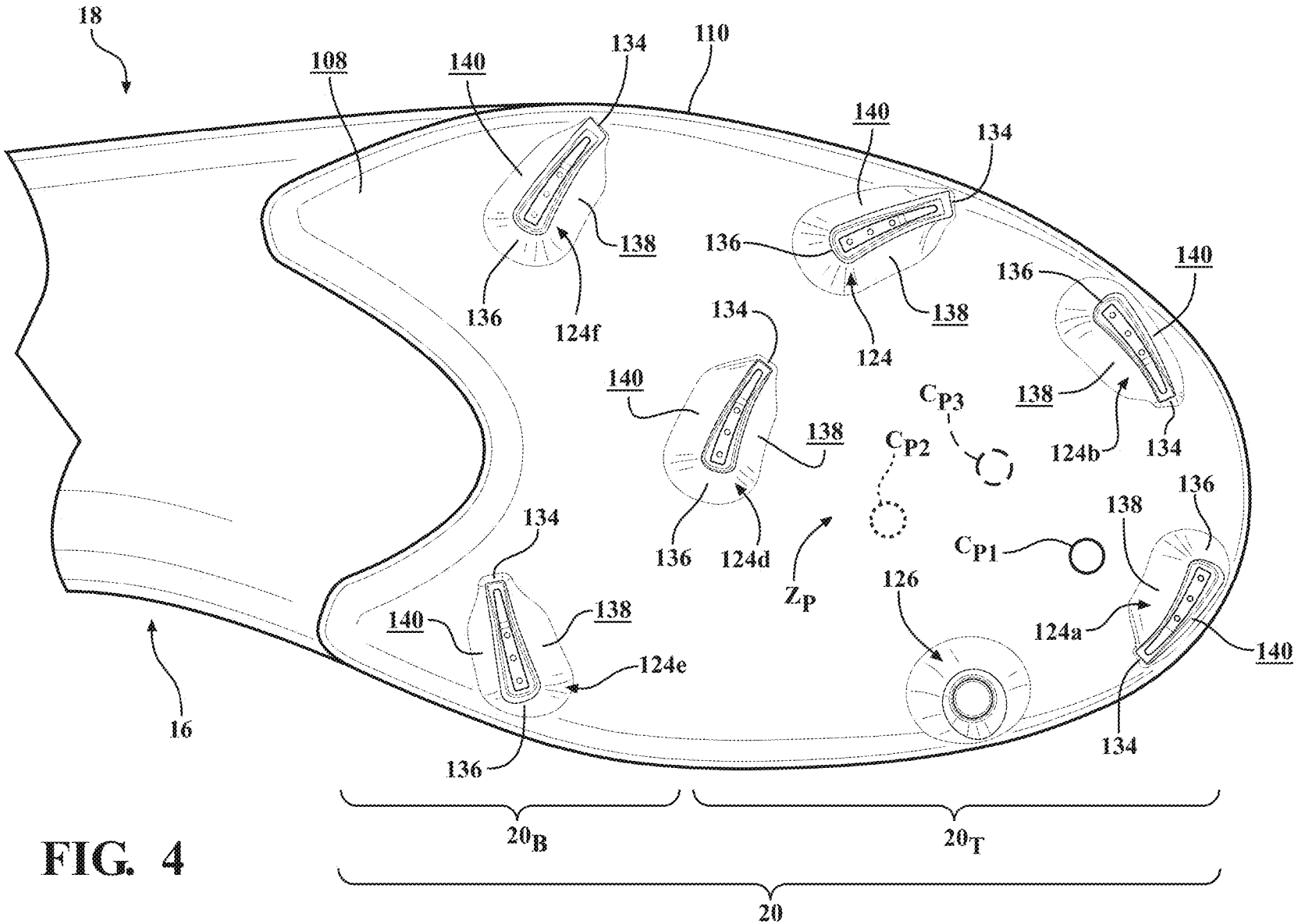
FIG. 4 is an enlarged fragmentary view of the article of footwear of FIG. 2, showing a forefoot region of the article of footwear.

With reference to FIGS. 2-4, the sole structure 100 includes a forefoot plate 102 attached to the upper 200 in the forefoot region 20 and a heel plate 104 attached to the upper 200 in the heel region 24. The sole structure 100 and/or the plates 102, 104 of the sole structure 100 may be described as including a top surface facing the upper and a bottom surface 108 formed on an opposite side of the sole structure 100 from the upper 200. An outer peripheral edge 110 connects the top surface 106 to the bottom surface 108 and defines an outer peripheral profile of the sole structure 100.

In the illustrated example, the forefoot plate 102 and the heel plate 104 are formed as separate components such that the forefoot plate 102 extends from a first end 112 at the anterior end 12 to a second end 114 adjacent to the mid-foot region 22. Here, a portion of the peripheral edge 110 defining the second end 114 of the forefoot plate 102 extends along a concave path from the medial side 16 to the lateral side 18 such that the second end 114 includes an arcuate recess 116 defining a pair of posterior-facing lobes 118 on opposite sides of the second end 112. The heel plate extends from a first end 120 adjacent to the mid-foot region 22 to a second end 122 at the posterior end 14. While the illustrated example includes the forefoot plate 102 and the heel plate 104 as separate components attached at opposite ends of the sole structure 100, the plates 102, 104 may be provided as a unitary component extending along an entire length of the article of footwear 10 from the anterior end 12 to the posterior end 14.

In the illustrated example, the sole structure 100 includes a plurality of directional traction elements **124-124*f* and an omnidirectional traction element 126. In this example, the directional traction elements 124-124*f* include unidirectional traction elements 124-124*f* provided as elongate members configured to move translationally through a ground surface (e.g., turf, soil) with a lower directional force in one direction than in an opposite direction, while the omnidirectional traction element 126** is provided as a round (i.e., cylindrical, conical, hemispherical) member configured to move through the ground surface in all directions with a substantially similar directional force.

With reference to FIGS. 2-4, each of the forefoot plate 102 and the heel plate 104 includes a plurality of the unidirectional traction elements **124-124*f*. As described herein, the unidirectional traction elements 124-124*f* may be alternatively referred to as blade cleats 124-124*f*. The blade cleats 124-124*f* may each be described as having a height extending from a proximal end 130 at the bottom surface 108 of the sole structure 100 to a distal end 132 spaced apart from the bottom surface 108 of the sole structure 100. Thus, the proximal end 130 of each blade cleat 124-124*f* forms a base 130 of the blade cleat 124-124*f* while the distal end 132 forms a tip 132 of the blade cleat 124-124*f*** configured to engage the ground surface.

With continued reference to FIGS. 2-4, a length of each of the blade cleats **124-124*f* extends from a first end 134 to a second end 136 disposed at an opposite end of the blade cleat 124-124*f* from the first end 134. Each blade cleat 124-124*f* further includes a pair of side surfaces 138, 140 formed on opposite sides of the blade cleat 124-124*f* and extending from the first end 134 to the second end 136. Accordingly, a width of each blade cleat 124-124*f* is defined by a distance between the side surfaces 138, 140. As shown, a width of each of the blade cleats 124-124*f* tapers along a direction from the second end 136 to the first end 134. Here, the width of each blade cleat 124-124*f* tapers continuously along the entire length of the blade cleat 124-124*f* from the second end 136 to the first end 134. In other words, a width of the each blade cleat 124-124*f* is greater at the second end 136 than at the first end 134 such that the blade cleat 124-124*f* is configured to move through a ground surface material (e.g., soil) in a direction from the first end 134 to the second end 136 with a lower resistance than in a direction from the second end 136 to the first end 134**.

In the illustrated example, each of the first surface 138 and the second surface 140 may be multi-faceted such that the blade cleats **124-124*f* each bend along a direction from the first end 134 to the second end 136. For instance, the first side surface 138 may include a first plurality of facets 142 arranged in series from the first end 134 to the second end 136. The facets 142 of the first side surface 138 are angled towards each other and cooperate to form a cupped or concave first surface 138, which may be referred to as an inner surface 138 of the blade cleat 124-124*f*. Conversely, the second surface 140 may include a second plurality of facets 144 arranged in series from the first end 134 to the second end 136 on the opposite side of the blade cleat 124-124*f* from the first surface 138. The facets 144 of the second surface 140 are angled away from each other and cooperate to provide the second surface 140 with a convex shape. Thus, the second surface 140 may be referred to as an outer surface 140. In the illustrated example, the inner surface 138 and the outer surface 140 each include a pair of the facets 142, 144 such that each blade cleat 124-124*f* may be described as including first and second segments. However, in other examples, a facet resolution of the inner surface 138 and/or the outer surface 140 may be increased such that the surfaces 138, 140 include a greater number of facets 142, 144** or are fully arcuate.

As discussed in greater detail below, the inner and outer surfaces 138, 140 of the blade cleats **124-124*f* are configured to be aligned along one or more rotational radii of the sole structure 100 such that the surfaces are substantially aligned along one or more rotational paths associated with the pivot zone $Z_P$. Thus, the elongate shapes of the blade cleats 124-124*f* provided by the tapering width and the curved surfaces 138, 140 facilitate movement of the blade cleats 124-124*f* through the ground surface along the direction of the side surfaces 138, 140 with relatively low resistance while providing a high level of resistance (i.e., traction) in a direction transverse to the side surfaces 138, 140**.

Optionally, each of the blade cleats **124-124*f* may include a chamfer 146 connecting the distal end 132 and the first end 134 of the blade cleat 124-124*f*. When included, the chamfer 146 includes a surface formed at an oblique angle between the distal end 132 and the first end 134 of the blade cleat 124-124*f*. The chamfer 146 provides the blade cleat 124-124*f* with a shorter length at the distal end 132 of the blade cleat 124-124*f* than at the base 130 of the blade cleat 124-124*f* such that the blade cleat 124-124*f* is configured to progressively engage the ground surface as the blade cleat 124-124*f*** is inserted into the ground surface.

In some examples, the blade cleats **124-124*f* include caps 148 attached at the distal end 132 and, when present, the chamfer 146. Here, the caps 148 include a different material than the blade cleat 124-124*f* and are configured to tune an interface between the blade cleats 124-124*f* and the ground surface. For instance, the caps 148 may include materials having a lower durometer or a higher coefficient of friction than the body of the blade cleat 124-124*f* to provide the blade cleats 124-124*f* with better traction on relatively hard ground surfaces. Alternatively, the caps 148 may include materials having a higher durometer than a material of the blade cleats 124-124*f* to provide each of the blade cleats 124-124*f*** with a hard tip for engaging softer ground surfaces.

With continued reference to FIGS. 2-4, the omnidirectional traction element 126 has a height extending from a proximal end 150 at the bottom surface 108 of the sole structure 100 to a distal end 152 spaced apart from the bottom surface 108 of the sole structure 100. Thus, the proximal end 150 forms a base 150 of the omnidirectional traction element 126 and the distal end 152 forms a tip 152 of the omnidirectional traction element.

Unlike the unidirectional traction elements **124-124*f*, which are substantially elongate in shape, the omnidirectional traction element 126 has a length and width that are substantially similar such that the omnidirectional traction element 126 is configured to move through the ground surface in all directions with substantially equal force or resistance. In the illustrated example, the omnidirectional traction element 126 is configured as a post cleat 126 having a substantially flat distal end 152. Specifically, the post cleat 126 is frustoconical such that a width or diameter of the post cleat 126 tapers along a direction from the base 150 to the tip 152. In other examples, the post cleat 126** may be cylindrical, hemispherical, or have an equilateral polygonal cross section.

Referring to FIGS. 3 and 4, the forefoot plate 102 of the present example includes a first annular cleat group 154 disposed generally in the toe portion 20*r* of the forefoot region 20 and a second annular cleat group 156 arranged through the ball portion 20 of the forefoot region 20. Here, the first annular cleat group 154 includes a plurality of the blade cleats 124*a*-124*d* and a single one of the post cleats 126 all arranged in series within a first annular zone $Z_{154}$ circumscribing the central pivot zone $Z_P$ associated with the centroids $C_{P1}$, $C_{P2}$, $C_{P3}$ discussed above. Similarly, the second annular cleat group 156 includes a pair of the blade cleats 124*e*, 124*f* arranged in series within a second annular zone $Z_{156}$ that is concentric with the first annular zone $Z_{154}$. Here, the first annular zone $Z_{154}$ is formed between a first minor radius $R_{154a}$ and a first major radius $R_{154b}$ and the second annular zone $Z_{156}$ is formed between a second minor radius $R_{156a}$ that is greater than the first major radius $R_{154a}$ and a second major radius $R_{156b}$. Thus, while the traction elements 124*a*-124*f*, 126 of each of the annular cleat groups 154, 156 are not aligned along a common radius, the traction elements 124*a*-124*f*, 126 of each cleat group 154, 156 are aligned within a radius range defined between the minor radii $R_{154a}$, $R_{156a}$ and the major radii $R_{154b}$, $R_{156b}$.

The first annular cleat group 154 may be referred to as an inner annular cleat group 154 and includes the post cleat 126 disposed immediately adjacent to the peripheral edge 110 on the medial side 16. The post cleat 126 is disposed between the anterior end 12 and the MTP axis $A_{MTP}$. The inner annular cleat group 154 includes four of the blade cleats 124*a*-124*d* arranged in series around the first annular zone $Z_{154}$. As shown, the blade cleats 124*a*-124*d* are arranged in the same rotational direction around the first annular zone $Z_{154}$ such that the first ends 134 of each one of the blade cleats 124*b*-124*d* face the second ends 136 of a preceding one of the blade cleats 124*a*-124*c* while the inner surface 138 of each blade cleat 124*a*-124*d* faces inwardly towards the pivot zone $Z_P$. Thus, the blade cleats 124*a*-124*d* are arranged to move in a rotational direction around the pivot zone $Z_P$.

Starting at the post cleat 126, the blade cleats 124*a*-124*d* are arranged in order including a first blade cleat 124*a* on the medial side 16 of the anterior end 12, a second blade cleat 124*b* on the lateral side 18 of the anterior end 12, a third blade cleat 124*c* immediately adjacent to the peripheral edge 110 on the lateral side 18, and a fourth blade cleat 124*d* adjacent to the longitudinal axis $A_{10}$ and the MTP axis $A_{MTP}$. As shown in FIG. 4, the first blade cleat 124*a* is oriented such that the first end 134 faces the post cleat 126 on the medial side 16 and the outer surface 140 of the first blade cleat 124*a* is adjacent and substantially parallel to the peripheral edge 110 of the forefoot plate 102. The first end 134 of the second blade cleat 124*b* faces the second end 136 of the first blade cleat 124*a* and the outer surface 140 converges with the peripheral edge 110 along a direction from the first end 134 to the second end 136. Thus, the first end 134 of the second blade cleat 124*b* is spaced apart from the peripheral edge 110 by a greater distance at the first end 134 than at the second end 136. The third blade cleat 124*c* is disposed immediately adjacent to the peripheral edge 110 on the lateral side 18 and diverges from the peripheral edge 110 along the direction from the first end 134 to the second end 136. The fourth blade cleat 124*d* is disposed in a central portion of the sole structure 100 adjacent to the longitudinal axis $A_{10}$ and is oriented such that the first end 134 is closer to the anterior end 12 and the medial side 16 than the second end 136.

With continued reference to FIGS. 3 and 4, the second annular cleat group 156 includes a pair of the blade cleats 124*e*, 124*f* arranged around the second annular zone $Z_{156}$. As provided above, the second annular zone $Z_{156}$ is concentric with the first annular zone $Z_{154}$ and has a larger radius than the first annular zone $Z_{156}$ such that the blade cleats 124*e*, 124*f* of the second annular cleat group 156 partially surround the first annular cleat group 154. Here, the second annular zone $Z_{156}$ is sized such that the blade cleats 124*e*, 124*f* of the second annular cleat group 156 are disposed on a posterior side of the MTP axis $A_{MTP}$ (i.e., in the ball portion 20B). The blade cleats 124*e*, 124*f* of the second annular cleat group 156 are arranged in the same rotational direction (e.g., clockwise, counterclockwise) around the pivot zone $Z_P$ as the blade cleats 124*a*-124*f* of the first annular cleat group 154. For example, the first ends 134 of each of the blade cleats 124*e*, 124*f* of the second annular cleat group 156 face the lateral side 18 of the sole structure 100. A first one of the blade cleats 124*e* of the second annular cleat group 156 is disposed adjacent to the medial side 16 and a second one of the blade cleats 124*f* of the second annular cleat group 156 is disposed adjacent to the lateral side 18. The inner surfaces 138 of each of the blade cleats 124*e*, 124*f* are oriented towards the pivot zone $Z_P$.

Figure 5:
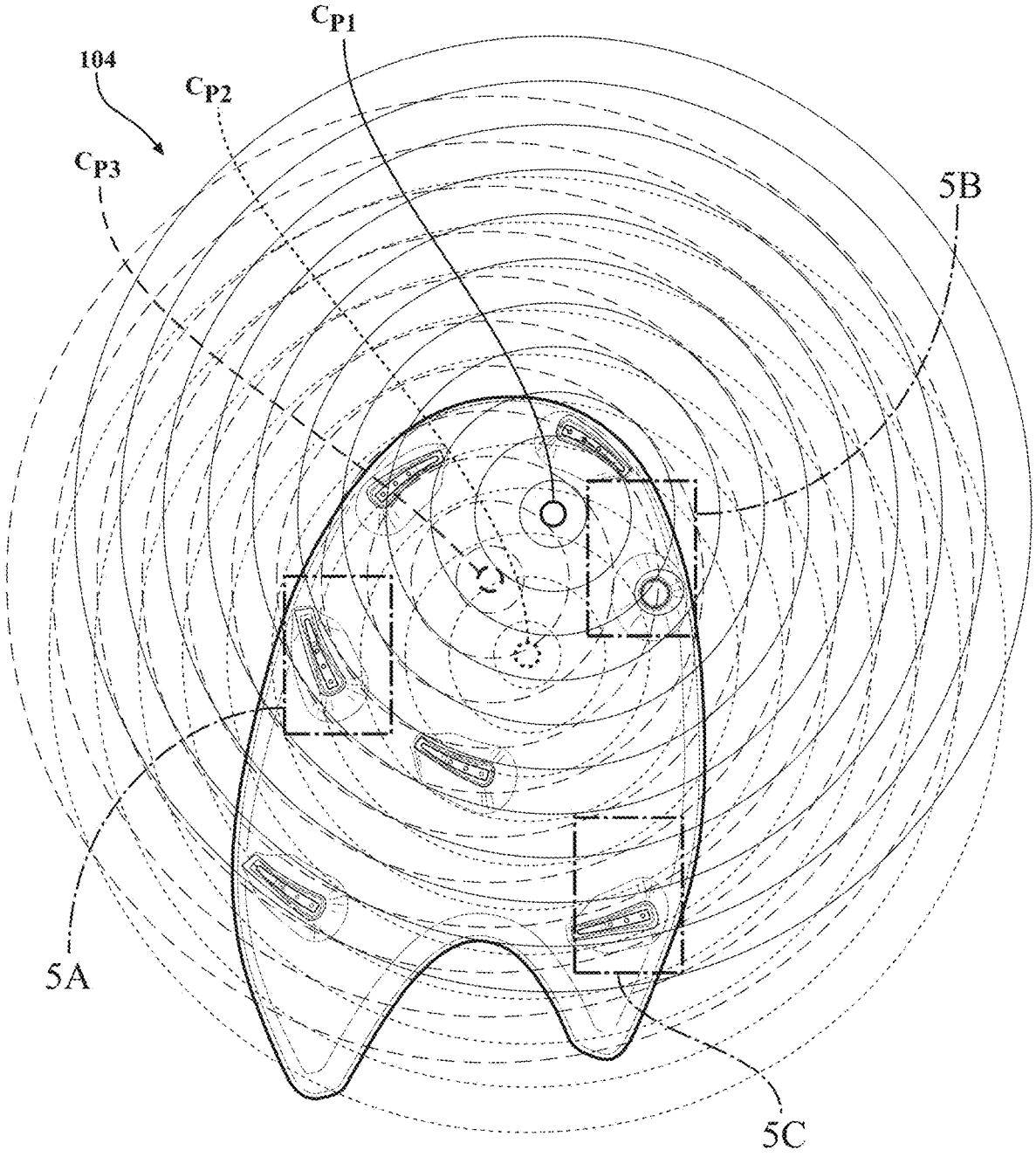
FIG. 5 is an environmental view of a forefoot plate of the article of footwear of FIG. 2 overlaid with the centroids and radii of rotation associated with the first, second, and third movements of FIG. 1D.
Figure 5A:
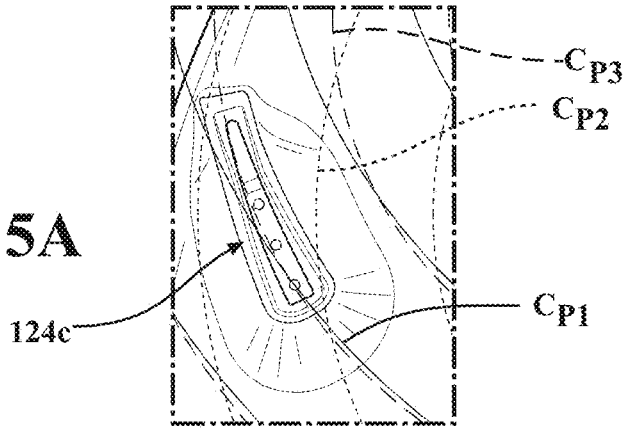
FIGS. 5A-5C are enlarged environmental views respectively taken at Areas 5A-5C of FIG. 5 and showing the radii of rotation associated with the first, second, and third movements.
Figure 5B:
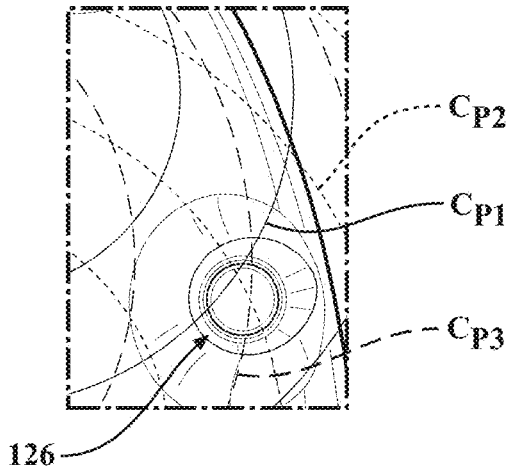
Figure 5C:
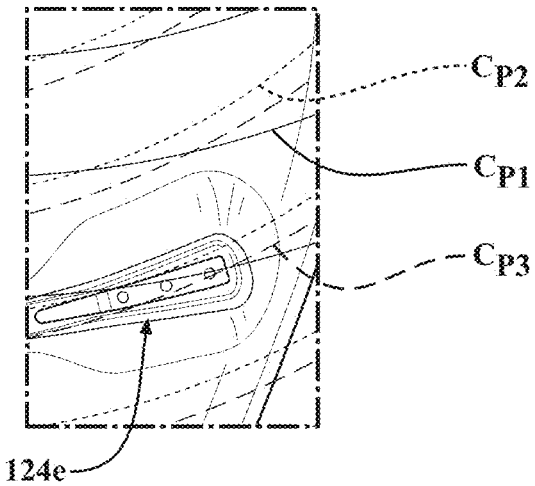

With reference to FIGS. 5-5C, the positions of one of the inner blade cleats 124*c*, one of the outer blade cleats 124*e*, and the post cleat 126 are illustrated relative to the radii of rotation associated with the pivot centroids $C_{P1}$, $C_{P2}$, $C_{P3}$. As provided above, the first pivot centroid $C_{P1}$ (FIG. 1A) is associated with a 45° outside cut, the second pivot centroid $C_{P2}$ (FIG. 1B) is associated with a 180° outside cut (FIG. 1B), and the third pivot centroid $C_{P3}$ (FIG. 1C) is associated with a 90° inside cut (e.g., accelerating, decelerating, or a planting kick).

With reference to FIG. 5A, the third blade cleat 124*c* of the inner annular cleat group 154 is shown with the radii of rotation associated with the pivot centroids $C_{P1}$, $C_{P2}$, $C_{P3}$ overlaid. Here, the length of the third blade cleat 124*c* (i.e., from the first end 134 to the second end 136) is substantially tangentially aligned along the radii of rotation associated with the first pivot centroid $C_{P1}$ and the third pivot centroid $C_{P3}$ and is oriented at an acute angle relative to the radius of rotation associated with the second pivot centroid $C_{P2}$. Thus, the third blade cleat 124*c* is configured to move in the rotational directions corresponding to the first and third centroids $C_{P1}$, $C_{P3}$.

FIG. 5B shows the position of the post cleat 126 of the inner annular cleat group 154 with the radii of rotation of the pivot centroids $C_{P1}$, $C_{P2}$, $C_{P3}$ overlaid. As shown, in Area 5B, the radii of rotation of the pivot centroids $C_{P1}$, $C_{P2}$, $C_{P3}$ are substantially misaligned such that there is no best-fit orientation for a unidirectional blade cleat 124. In other words, incorporating a directional traction element at Area 5B to accommodate rotational movement about one of the centroids $C_{P1}$, $C_{P2}$, $C_{P3}$ would result in a relatively high degree of rotational resistance (i.e., traction) to rotational movement about the other two centroids $C_{P1}$, $C_{P2}$, $C_{P3}$. Accordingly, the omnidirectional post cleat 126 is placed at Area 5B to accommodate each of the different radii of rotation of the centroids $C_{P1}$, $C_{P2}$, $C_{P3}$.

In FIG. 5C, the medial side blade cleat 124*e* of the outer annual cleat group 156 is shown with the radii of rotation of the pivot centroids $C_{P1}$, $C_{P2}$, $C_{P3}$ overlaid. Here, the radii of rotation of the pivot centroids $C_{P1}$, $C_{P2}$, $C_{P3}$ have a relatively high degree of tangential alignment such that the medial blade cleat 124*e* is oriented to align the inner and outer surfaces 138, 140 with each of the radii of rotation of the pivot centroids $C_{P1}$, $C_{P2}$, $C_{P3}$. Thus, the medial blade cleat 124*e* is configured to move in the rotational directions corresponding to the first, second, and third centroids $C_{P1}$, $C_{P2}$, $C_{P3}$.

With continued reference to FIG. 5, the blade cleats 124*e*-124*f* of the forefoot plate 102 are positioned at areas of the forefoot plate 102 where the radii of rotation of at least two of the pivot centroids $C_{P1}$, $C_{P2}$, $C_{P3}$ are aligned. For instance, in addition to the blade cleats 124*c*, 124*e* discussed with respect to FIGS. 5A and 5C, FIG. 5 shows the first blade cleat 124*a* of the inner annular cleat group 154 located where the radii of rotation for the first and third pivot centroids $C_{P1}$, $C_{P3}$ are aligned while the second blade cleat 124*b* of the inner annular cleat group 154 is located where the radii of rotation for the second and third pivot centroids $C_{P1}$, $C_{P2}$ are aligned. The fourth blade cleat 124*d* of the inner annular cleat group 154 and the lateral blade cleat 124*f* of the outer annular cleat group 156 are each positioned at areas with relatively high degrees of alignment between the radii of rotation of all three of the pivot centroids $C_{P1}$, $C_{P2}$, $C_{P3}$.

As shown in FIG. 3, the heel plate 104 includes a plurality of the blade cleats 124 each oriented along the same rotational direction about the pivot zone $Z_P$ as the blade cleats 124*a*-124*f* of the forefoot plate 102. In the illustrated example, the heel plate 104 includes two pairs of the blade cleats 124, with a first pair aligned longitudinally along the lateral side 18 of the longitudinal axis $A_{10}$ and a second pair aligned longitudinally along the medial side 16 of the longitudinal axis $A_{10}$. Here, all of the blade cleats 124 of the heel plate 104 include the first ends 134 facing towards the lateral side 18 of the sole structure 100. The blade cleats 124 on the medial side 16 of the longitudinal axis $A_{10}$ are oriented such that the second end 136 faces the medial side 16 and is closer to the anterior end 12 than the first end 134. Similarly, the blade cleats 124 on the lateral side 18 of the longitudinal axis $A_{10}$ are oriented such that the first end 134 faces the lateral side 18 and is closer to the anterior end 12 than the second end 136.

As provided above, all of the blade cleats 124-124*f* of the forefoot plate 102 and the heel plate 104 are oriented in the same rotational direction (i.e., clockwise, counterclockwise) such that the inner surfaces 138 and the outer surfaces 140 are substantially tangential to concentric radii of rotation about the pivot zone $Z_P$. Thus, the tapered, elongate, and bent shapes of the blade cleats 124 allow the sole structure 100 to rotate about the pivot zone $Z_P$ with a minimized torsional force while the inner surfaces 138 and the outer surfaces 140 of the blade cleats 124 are configured to provide increased traction in lateral and longitudinal directions of the sole structure 100.

Figure 6:
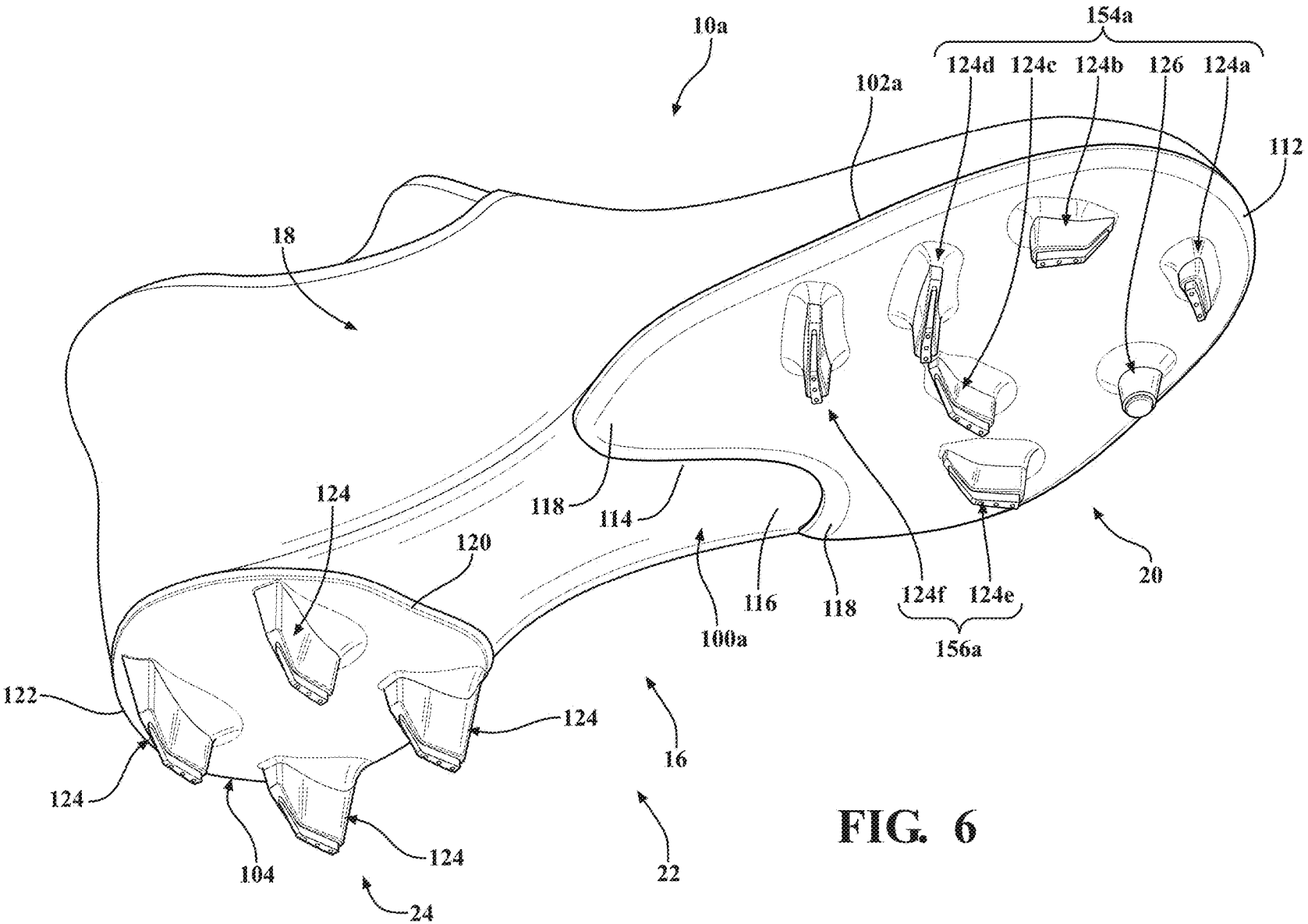
FIG. 6 is a bottom perspective view of an example of an article of footwear according to the present disclosure.
Figure 7:
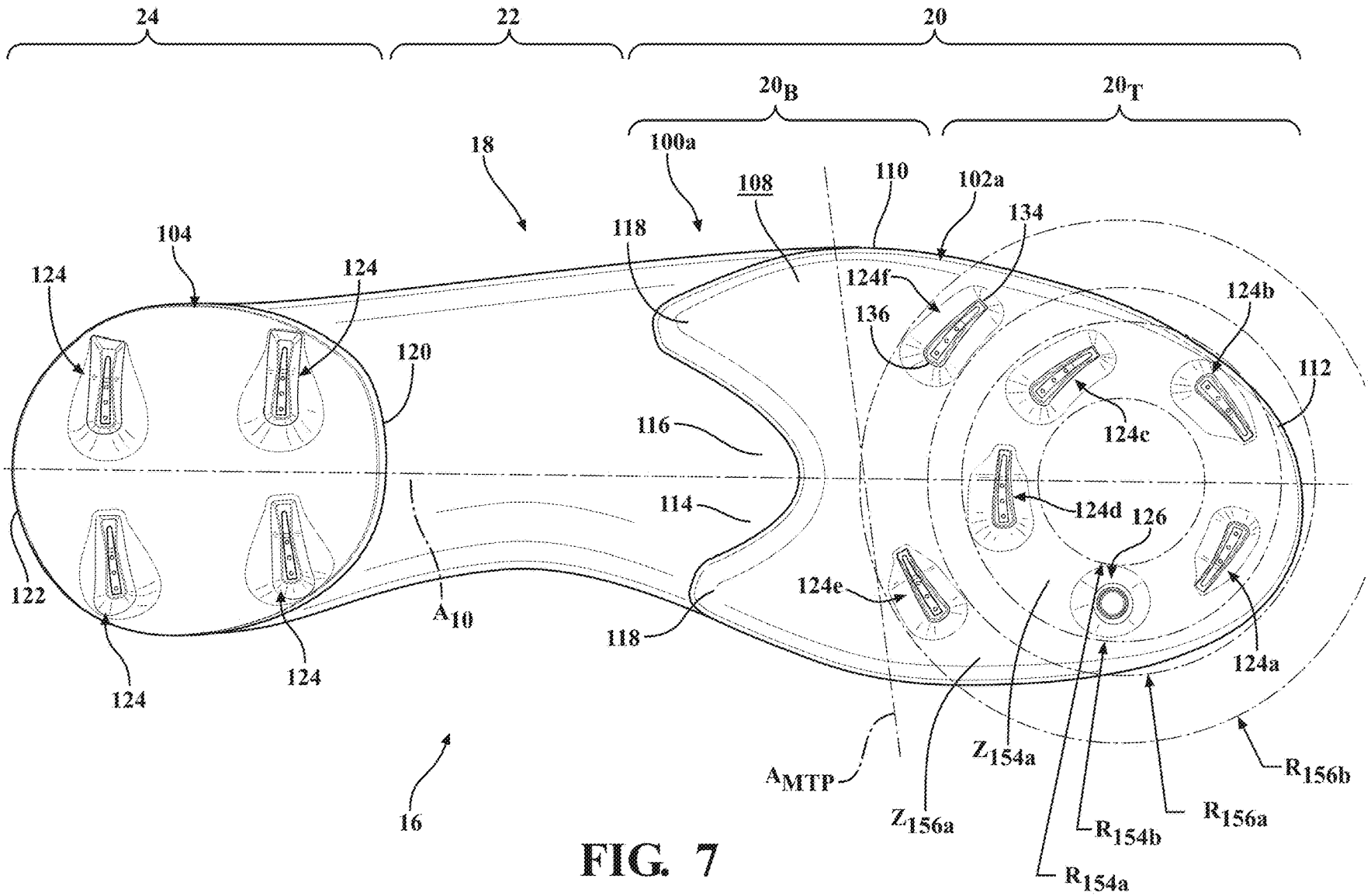
FIG. 7 is a bottom plan view of the article of footwear of FIG. 6.
Figure 8:
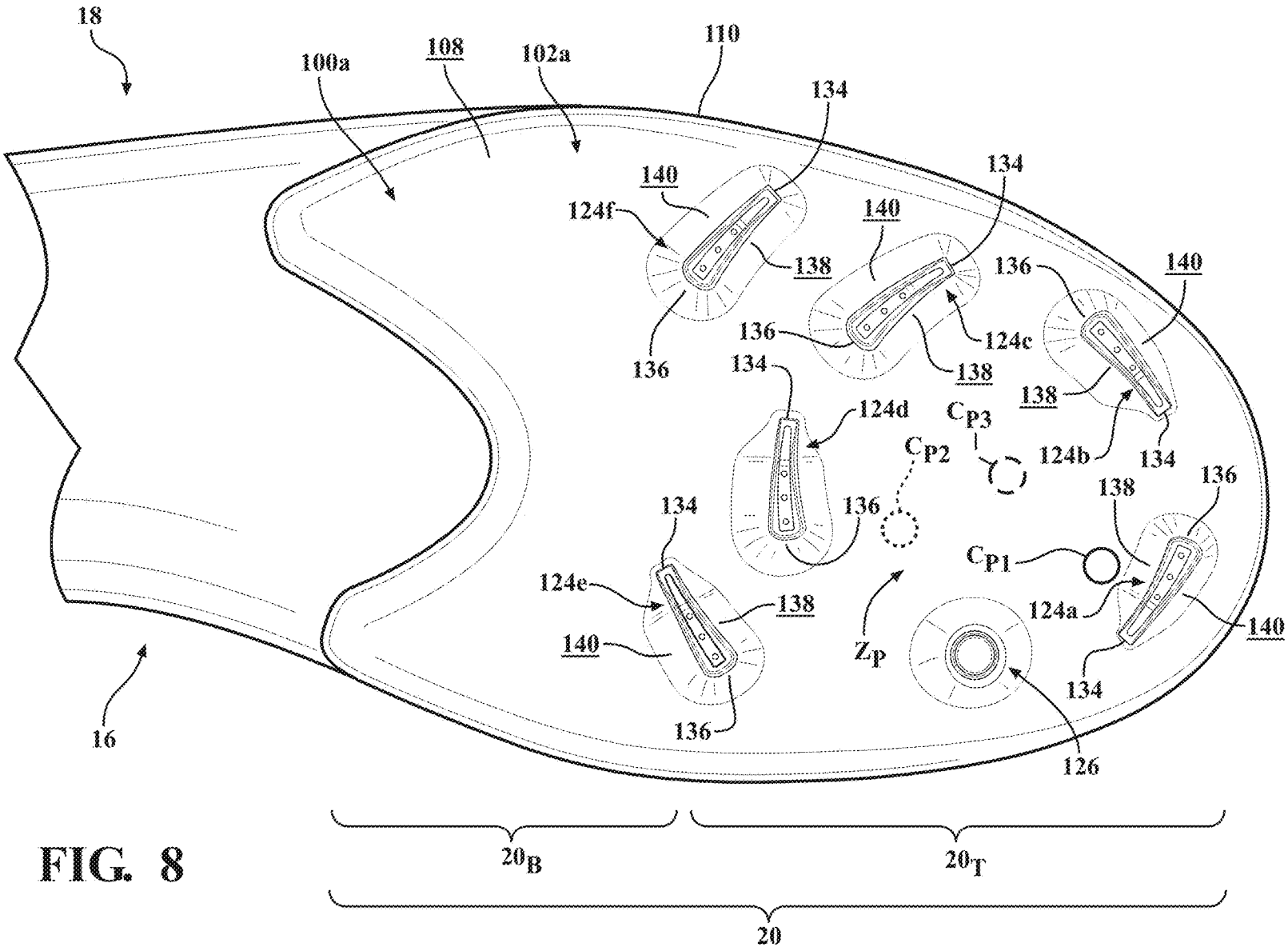
FIG. 8 is an enlarged fragmentary view of the article of footwear of FIG. 6, showing a forefoot region of the article of footwear.

With particular reference to FIGS. 6-8, an article of footwear 10*a* is provided and includes a sole structure 100*a* and the upper 200 attached to the sole structure 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

In the example of the sole structure 100*a* shown in FIGS. 6-8, a forefoot plate 102*a* includes an inner annular cleat group 154*a* and an outer annular cleat group 156*a* that are similar to the inner annular cleat group 154 and the outer annular cleat group 156 discussed previously. However, in this example, the radii $R_{154a}$, $R_{154b}$, $R_{156a}$, $R_{156b}$ of the annular zones $Z_{154}$, $Z_{156}$ have been reduced such that the inner and outer annular cleat groups 154*a*, 156*a* are more tightly grouped around the pivot zone $Z_P$. For example, the post cleat 126 and the first, second, and third blade cleats 124*a*-124*c* are offset inwardly from the peripheral edge 110 of the sole structure 100. Furthermore, the blade cleats 124*e*, 124*f* of the outer annular cleat group 156*a* are each positioned on an anterior side of the MTP axis $A_{MTP}$ (i.e., in the toe portion 20*r*).

By reducing the respective radii of the cleat groups 154*a*, 154*b*, a torsional force required to rotate or twist the cleat groups 154*a*, 154*b* about the pivot zone $Z_P$ through the ground surface is reduced relative to a torsional force associated with the sole structure 100 discussed previously. However, while the torsional forces associated with the sole structure 100*a* are reduced, the rotational configuration of the traction elements 124, 126 provides translational (e.g., lateral, longitudinal) traction forces comparable to the forces provided by the sole structure 100, as the inner and outer surfaces 138, 140 of the blade cleats 124 cooperate to engage the ground surface in different translational directions.

Figure 9:
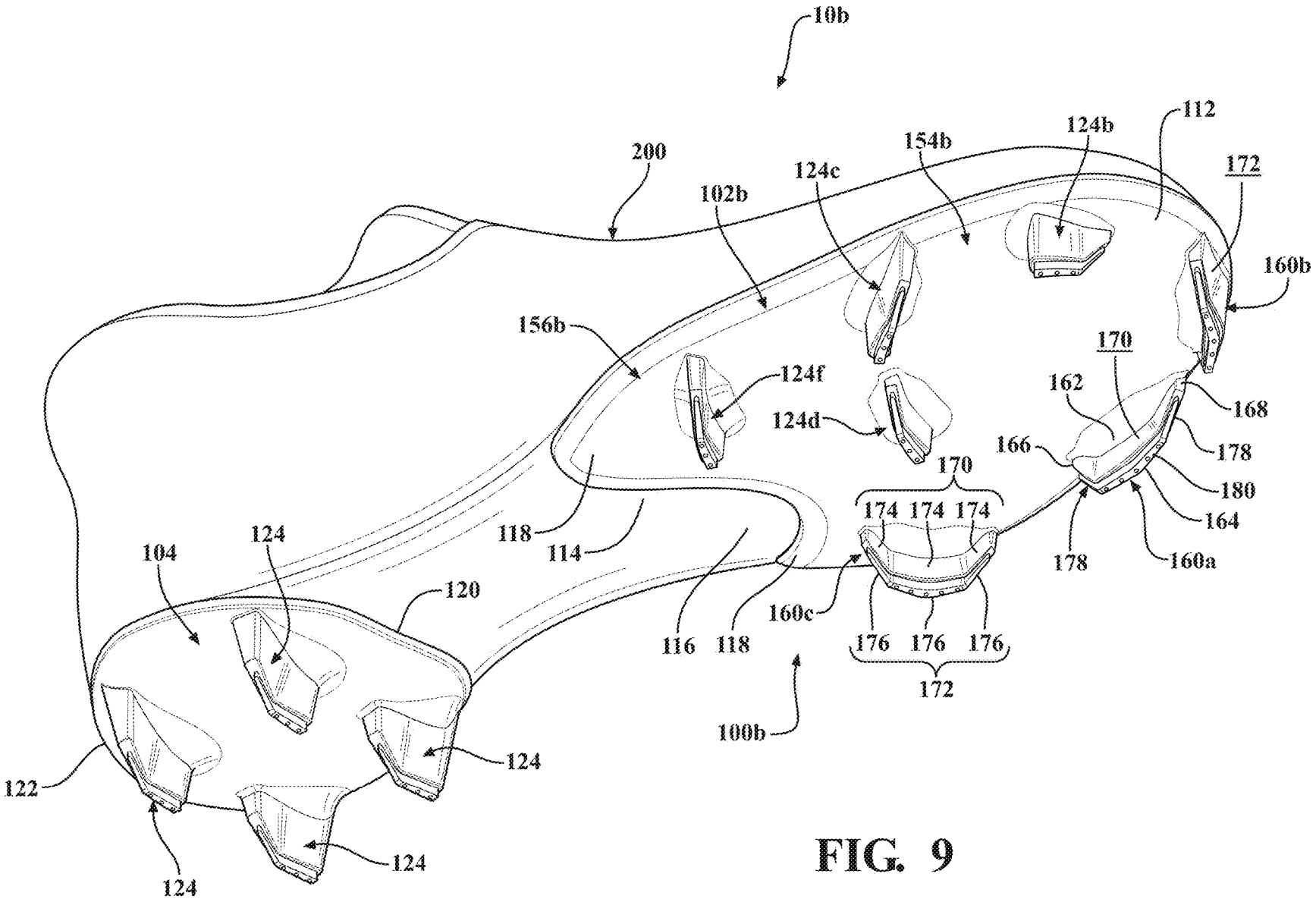
FIG. 9 is a bottom perspective view of an example of an article of footwear according to the present disclosure.
Figure 10:
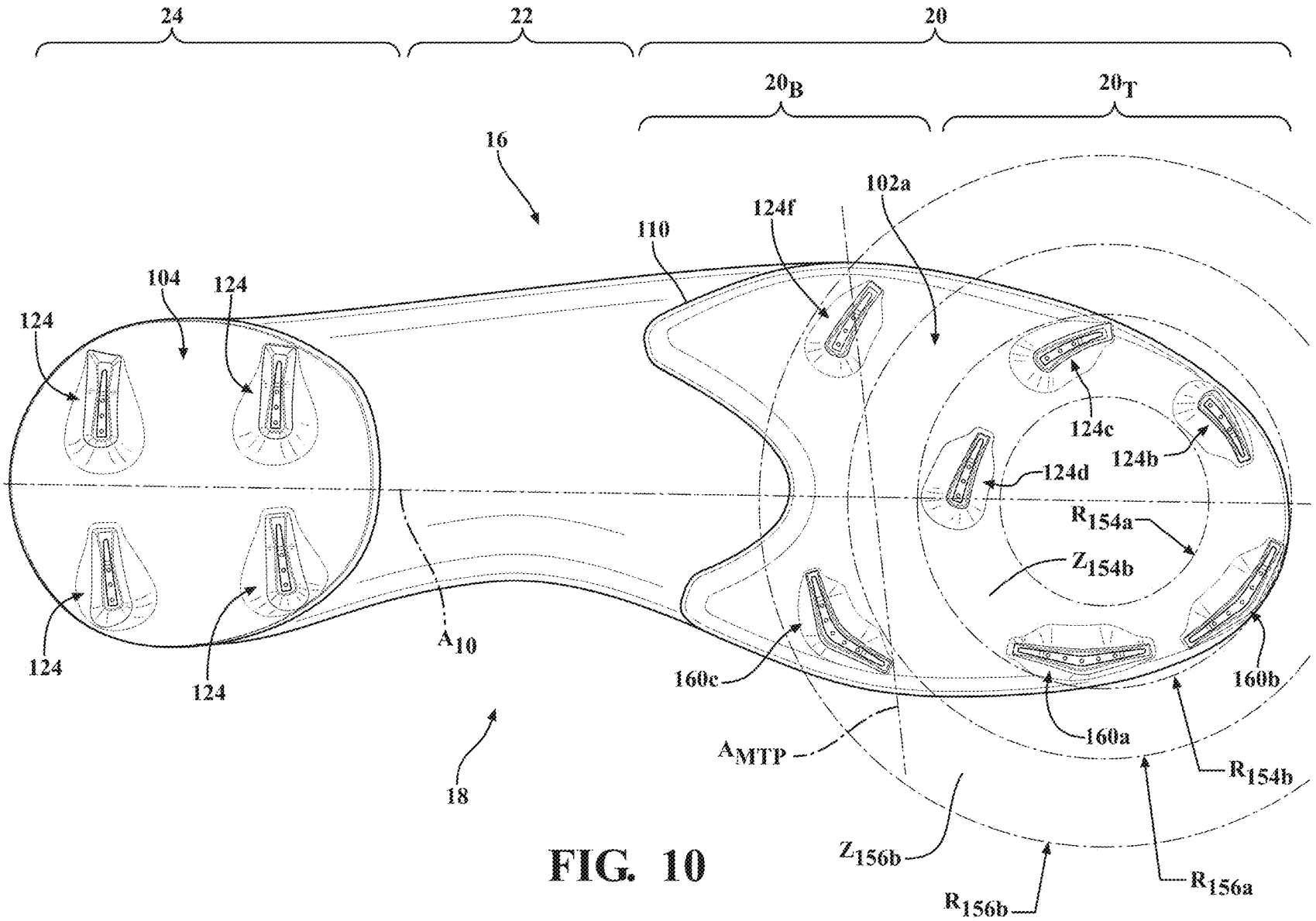
FIG. 10 is a bottom plan view of the article of footwear of FIG. 9.
Figure 11:
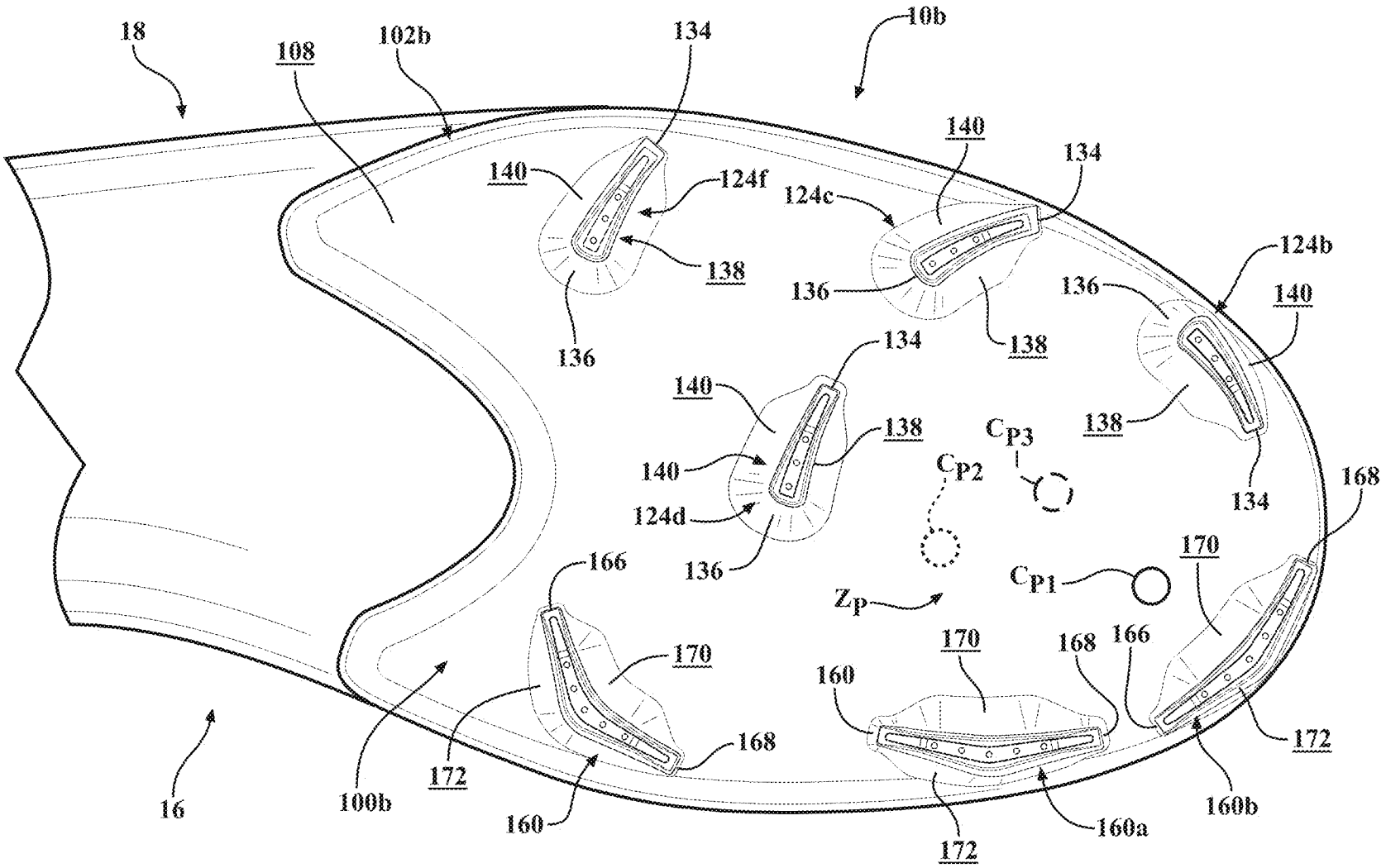
FIG. 11 is an enlarged fragmentary view of the article of footwear of FIG. 9, showing a forefoot region of the article of footwear.

With particular reference to FIGS. 9-11, an article of footwear 10*b* is provided and includes a sole structure 100*b* and the upper 200 attached to the sole structure 100*b*. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

The sole structure 100*b* of FIGS. 9-11 is substantially similar to the sole structure 100 discussed above and includes an inner annular cleat group 154*b* and an outer annular cleat group 156*b* arranged around annular zones $Z_{154}b$, $Z_{156}b$. As with the sole structure 100 discussed above, the inner annular cleat group 154*b* is arranged along an annular zone $Z_{154}$ such that the traction elements 124*b*-124*d*, 160*a*-160*b* of the inner annular cleat group 154*b* are adjacent to the peripheral edge 110 of the forefoot plate 102*b* and the traction elements 124*f*, 160*c* of the outer annular cleat group 156*b* are positioned on a posterior side of the MTP axis $A_{MTP}$ (i.e., in the ball portion 20B).

The sole structure 100*b* of the present example includes a plurality of bi-directional traction elements 160*a*-160*c* in addition to the unidirectional traction elements 124*b*-124*d*, 124*f*. For example, where the sole structure 100 discussed above includes the post cleat 126, the first blade cleat 124*a* of inner annular cleat group 154, and the medial blade cleat 124*e* of the outer annular cleat group 156, the sole structure 100*b* of the present example includes bi-directional traction elements 160*a*-160*c* incorporated into the annular cleat groups 154*b*, 156*b*. Generally, the bi-directional traction elements 160*a*-160*c* are formed as symmetrical wing cleats 160*a*-160*c* configured to allow bi-directional movement along a lengthwise direction of the traction element 160*a*-160*c*. The bi-directional traction elements 160*a*-160*c* and the unidirectional traction elements 124*b*-124*d*, 124*f* may be collectively referred to as directional traction elements.

With reference to FIG. 9, each of the wing cleats 160*a*-160*c* includes height extending from a proximal end 162 at the bottom surface 108 of the sole structure 100 to a distal end 164 spaced apart from the bottom surface 108 of the sole structure 100. Thus, the proximal end 162 forms a base of the wing cleat 160*a*-160*c* and the distal end 164 forms a tip of the wing cleat 160*a*-160*c*.

With continued reference to FIGS. 9-11, a length of each of the wing cleats 160*a*-160*c* extends from a first end 166 to a second end 168 disposed at an opposite end of the wing cleat 160*a*-160*c* from the first end 166. Each wing cleat 160*a*-160*c* further includes a pair of side surfaces 170, 172 formed on opposite sides of the wing cleat 160*a*-160*c* and extending from the first end 166 to the second end 168. Accordingly, a width of each wing cleat 160*a*-160*c* is defined by a distance between the side surfaces 170, 172. As shown, the width of each of the wing cleats 160*a*-160*c* tapers along the length from an intermediate portion towards each end 166, 168. In other words, a width of the each wing cleat 160*a*-160*c* is greater in a central portion than at the first end 166 and second end 168 such that the wing cleat 160 is configured to slice through a ground surface material (e.g., soil) in a direction towards either end 166, 168.

In the illustrated example, each of the first side surface 170 and the second side surface 172 may be multi-faceted such that the wing cleats 160*a*-160*c* each bend along a direction from the first end 166 to the second end 168. For instance, the first side surface 170 may include a first plurality of facets 174 arranged in series from the first end 166 to the second end 168. The facets 174 of the first side surface 170 are angled towards each other and cooperate to form a cupped or concave first side surface 170, which may be referred to as an inner surface 170 of the wing cleat 160*a*-160*c*. Conversely, the second surface 172 may include a second plurality of facets 176 arranged in series from the first end 166 to the second end 168 on the opposite side of the wing cleat 160*a*-160*c* from the first side surface 170. The facets 176 of the second side surface 172 are angled away from each other and cooperate to provide the second side surface 172 with a convex shape. Thus, the second side surface 172 may be referred to as an outer surface 172. In the illustrated example, the inner side surface 170 and the outer side surface 172 each include three of the facets 174, 176 such that each wing cleat 160*a*-160*c* may be described as including first and second end segments extending from an intermediate segment. However, in other examples, a facet resolution of the inner surface 170 and/or the outer surface 172 may be increased such that the surfaces 170, 172 include a greater number of facets 174, 176 or are fully arcuate.

Optionally, each of the wing cleats 160*a*-160*c* may include a pair of chamfers 178 connecting the distal end 164 and with each of the first end 166 and the second end 168. When included, the chamfers 178 include a surface formed at an oblique angle relative to the distal end 164 and each of the first end 166 and the second end 168 of the wing cleat 160*a*-160*c*. The chamfers 178 provide the wing cleat 160*a*-160*c* with a shorter length at the distal end 164 of the wing cleat 160*a*-160*c* than at the base 162 of the wing cleat 160 such that the wing cleat 160 is configured to progressively engage the ground surface as the wing cleat 160*a*-160*c* is inserted into the ground surface.

In some examples, the wing cleats 160*a*-160*c* include caps 180 attached at the distal end 164 and, when present, the chamfers 178. Here, the caps 180 include a different material than the body of the wing cleats 160*a*-160*c* and are configured to tune an interface between the wing cleats 160*a*-160*c* and the ground surface. For instance, the caps 180 may include materials having a lower durometer or a higher coefficient of friction to provide the wing cleats 160*a*-160*c* with better traction on relatively hard ground surfaces. Alternatively, the caps 180 may include materials having a higher durometer than a material of the wing cleats 160*a*-160*c* to provide each of the wing cleats 160*a*-160*c* with a hard tip for engaging softer ground surfaces.

The following Clauses provide an exemplary configuration of a sole structure and an article of footwear described above.

Clause 1: A sole structure for an article of footwear, the sole structure comprising: a first plurality of traction elements including a first series of directional traction elements arranged within a first annular zone in a first rotational direction around a pivot zone; and a second plurality of traction elements including a second series of directional traction elements arranged within a second annular zone concentric with and larger than the first annular zone, the second plurality of traction elements arranged in the first rotational direction around the pivot zone.

Clause 2: The sole structure of Clause 1, wherein each of the directional traction elements is elongate and includes a length extending from a first end to a second end along the first rotational direction.

Clause 3: The sole structure of Clause 2, wherein each of the directional traction elements includes a chamfer formed adjacent to at least one of the first end and the second end.

Clause 4: The sole structure of Clause 2 or 3, wherein each of the directional traction elements includes a concave inner surface and a convex outer surface each extending along the first rotational direction.

Clause 5: The sole structure of Clause 4, wherein the inner surface converges with the outer surface along the first rotational direction.

Clause 6: The sole structure of any one of Clauses 1-5, further comprising a third plurality of directional traction elements disposed in a heel region, each of the directional traction elements of the third plurality of directional traction elements oriented in the first rotational direction.

Clause 7: The sole structure of any one of Clauses 1-6, wherein the first plurality of traction elements and the second plurality of traction elements are disposed in a forefoot region of the sole structure.

Clause 8: The sole structure of any one of Clauses 1-7, wherein the first plurality of traction elements further includes an omnidirectional traction element arranged within the first annular zone.

Clause 9: The sole structure of Clause 8, wherein the omnidirectional traction element is disposed on a medial side of the sole structure and at least one of the directional traction elements of the first series is disposed on a lateral side of the sole structure.

Clause 10: The sole structure of any one of Clauses 1-9, wherein at least one of directional traction elements includes a unidirectional traction element and at least one of the directional traction elements includes a bidirectional traction element.

Clause 11: A sole structure for an article of footwear, the sole structure comprising: a first annular group of traction elements arranged in series along a first annular zone in a forefoot region, the first annular group including a first directional traction element on a lateral side of the sole structure and a second directional traction element on a medial side of the sole structure;

and a second annular group of traction elements arranged in series along a second annular zone concentric with the first annular zone, the second annular group of traction elements including a third directional traction element on the lateral side of the sole structure and a fourth directional traction element on the medial side of the sole structure.

Clause 12: The sole structure of Clause 11, wherein each of the directional traction elements is elongate and includes a length extending from a first end to a second end along a first rotational direction around a pivot zone of the sole structure.

Clause 13: The sole structure of Clause 12, wherein each of the directional traction elements includes a chamfer formed adjacent to at least one of the first end and the second end.

Clause 14: The sole structure of Clause 12 or 13, wherein each of the directional traction elements includes a concave inner surface and a convex outer surface each extending along the first rotational direction.

Clause 15: The sole structure of Clause 14, wherein the inner surface converges with the outer surface along the first rotational direction.

Clause 16: The sole structure of any one of Clauses 11-15, further comprising a third group of directional traction elements disposed in a heel region, each of the directional traction elements of the third group of directional traction elements oriented in the first rotational direction.

Clause 17: The sole structure of any one of Clauses 11-16, wherein the first annular group and the second annular group are disposed in a forefoot region of the sole structure.

Clause 18: The sole structure of any one of Clauses 11-17, wherein the first annular group of traction elements further includes an omnidirectional traction element arranged along the first annular zone.

Clause 19: The sole structure of Clause 18, wherein the omnidirectional traction element is disposed on a medial side of the sole structure.

Clause 20: The sole structure of any one of Clauses 11-19, wherein at least one of directional traction elements includes a unidirectional traction element and at least one of the directional traction elements includes a bidirectional traction element.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a plurality of directional traction elements including a plurality of blade cleats arranged within a first annular zone, each of the plurality of directional traction elements being oriented in a first rotational direction around a pivot zone and tapering in the first rotational direction; and a plurality of bidirectional traction elements including a first wing cleat and a second wing cleat aligned with directional traction elements of the plurality of directional traction elements in the first rotational direction and each tapering from an intermediate portion to a first end and from the intermediate portion to a second end located on an opposite side of the respective first wing cleat and second wing cleat than the first end, a circumferential spacing between the first wing cleat and the second wing cleat being less than the circumferential spacing between adjacent blade cleats of the plurality of blade cleats.

2. The sole structure of claim 1, wherein the first wing cleat and the second wing cleat are disposed closer to a medial side of the sole structure than blade cleats of the plurality of blade cleats.

3. The sole structure of claim 1, wherein blade cleats of the plurality of blade cleats are disposed closer to a lateral side of the sole structure than the first wing cleat and the second wing cleat.

4. The sole structure of claim 1, wherein each blade cleat of the plurality of blade cleats is elongate and includes a length extending from a first end to a second end along the first rotational direction.

5. The sole structure of claim 1, wherein each blade cleat of the plurality of blade cleats includes a concave surface opposing the first wing cleat and the second wing cleat.

6. The sole structure of claim 5, wherein each blade cleat of the plurality of blade cleats includes a convex surface disposed on an opposite side of each blade cleat than the concave surface.

7. The sole structure of claim 1, wherein the plurality of directional traction elements and the plurality of bidirectional traction elements are disposed in a forefoot region of the sole structure.

8. The sole structure of claim 1, wherein the first wing cleat and the second wing cleat each includes a concave surface opposing blade cleats of the plurality of blade cleats.

9. The sole structure of claim 1, wherein at least one of the first wing cleat and the second wing cleat is symmetric.

10. An article of footwear incorporating the sole structure of claim 1.

11. A sole structure for an article of footwear, the sole structure comprising:

a plurality of directional traction elements including a plurality of blade cleats arranged within a first annular zone, each of the plurality of directional traction elements being oriented in a first rotational direction around a pivot zone and tapering in the first rotational direction; and a plurality of bidirectional traction elements including a first wing cleat and a second wing cleat aligned with directional traction elements of the plurality of directional traction elements in the first rotational direction and each tapering from an intermediate portion to a first end and from the intermediate portion to a second end located on an opposite side of the respective first wing cleat and second wing cleat than the first end, a circumferential spacing between each wing cleat and an adjacent blade cleat is greater than the circumferential spacing between the first wing cleat and the second wing cleat.

12. The sole structure of claim 11, wherein the first wing cleat and the second wing cleat are disposed closer to a medial side of the sole structure than blade cleats of the plurality of blade cleats.

13. The sole structure of claim 11, wherein blade cleats of the plurality of blade cleats are disposed closer to a lateral side of the sole structure than the first wing cleat and the second wing cleat.

14. The sole structure of claim 11, wherein each blade cleat of the plurality of blade cleats is elongate and includes a length extending from a first end to a second end along the first rotational direction.

15. The sole structure of claim 11, wherein each blade cleat of the plurality of blade cleats includes a concave surface opposing the first wing cleat and the second wing cleat.

16. The sole structure of claim 15, wherein each blade cleat of the plurality of blade cleats includes a convex surface disposed on an opposite side of each blade cleat than the concave surface.

17. The sole structure of claim 11, wherein the plurality of directional traction elements and the plurality of bidirectional traction elements are disposed in a forefoot region of the sole structure.

18. The sole structure of claim 11, wherein the first wing cleat and the second wing cleat each includes a concave surface opposing blade cleats of the plurality of blade cleats.

19. The sole structure of claim 11, wherein at least one of the first wing cleat and the second wing cleat is symmetric.

20. An article of footwear incorporating the sole structure of claim 11.

* * * * *